US005230154A

United States Patent [19]

Decker et al.

[11] Patent Number: 5,230,154

[45] Date of Patent: Jul. 27, 1993

[54] MODULAR POWER-DRIVEN ROTARY KNIFE, IMPROVED HANDLE AND METHOD

[75] Inventors: Richard B. Decker; Richard P. Bozzi, both of Vermilion, Ohio

[73] Assignee: Bettcher Industries, Inc., Birmingham, Ohio

[21] Appl. No.: 590,026

[22] Filed: Sep. 28, 1990

[51] Int. Cl.[5] ..... B26B 7/00

[52] U.S. Cl. ..... 30/276; 16/114 R; 30/329

[58] Field of Search ..... 30/85, 276, 125, 329; 16/111 R, 114 R, DIG. 19

[56] References Cited

U.S. PATENT DOCUMENTS

| | | | |
|---|---|---|---|
| Re. 25,947 | 12/1965 | Bettcher | 30/276 |
| 108,141 | 10/1870 | Houseman et al. . | |
| 309,131 | 12/1984 | Carter . | |
| 1,532,822 | 5/1923 | Kemp . | |
| 2,350,494 | 4/1943 | Champlin et al. | 279/95 |
| 2,827,657 | 3/1958 | Bettcher | 30/276 |
| 2,877,018 | 3/1959 | Turner | 273/81.4 |
| 3,122,774 | 3/1964 | Lamb | 16/110 |
| 3,269,010 | 8/1966 | Bettcher | 30/276 |
| 3,688,403 | 9/1972 | Bettcher | 30/276 |
| 3,852,882 | 12/1974 | Bettcher | 30/276 |
| 3,971,094 | 7/1976 | Solf et al. | 15/143 R |
| 4,102,049 | 7/1978 | Harth | 33/1 B |
| 4,116,440 | 9/1978 | Takeshima | 273/81.4 |
| 4,142,291 | 3/1979 | Bettcher | 30/276 |
| 4,161,051 | 7/1979 | Brodwin | 16/110 R |
| 4,166,317 | 9/1979 | Bettcher | 30/276 |
| 4,170,063 | 10/1979 | Bettcher | 30/276 |
| 4,175,321 | 11/1979 | Bettcher | 30/276 |
| 4,178,683 | 12/1979 | Bettcher | 30/276 |
| 4,186,924 | 2/1980 | Southey | 273/81.4 |
| 4,198,750 | 4/1980 | Bettcher | 30/276 |
| 4,236,531 | 12/1980 | McCullough | 30/276 |
| 4,272,077 | 7/1981 | Spivey | 273/81 R |
| 4,363,170 | 12/1982 | McCullough | 30/276 |
| 4,439,924 | 4/1984 | Bettcher | 30/276 |
| 4,466,377 | 8/1984 | Kolb et al. | 16/114 R |
| 4,492,027 | 1/1985 | Bettcher | 30/276 |
| 4,494,311 | 1/1985 | McCullough | 30/276 |
| 4,509,261 | 4/1985 | Bettcher | 30/276 |
| 4,516,323 | 5/1985 | Bettcher et al. | 30/276 |
| 4,575,937 | 3/1986 | McCullough | 30/276 |

(List continued on next page.)

OTHER PUBLICATIONS

Honsa Ergonomic Technologies, Inc. information sheer for Honsa Ergrip Handle (undated).

*Primary Examiner*—Frank T. Yost
*Assistant Examiner*—Hwei-Siu Payer
*Attorney, Agent, or Firm*—Watts, Hoffmann, Fisher & Heinke Co.

[57] ABSTRACT

A modular power-driven knife having an annular rotary blade, the structure of which knife can be varied through choice of standardized, i.e., compatible, components to accommodate different operators and different tasks. The components include plural elongated handles to accommodate different sized hands; plural headpieces, each having a transmission for driving an annular rotary blade and identical means by which any of the handles are attachable in a first orientation, and each differently constructed to support a replaceable blade housing of predetermined size and construction different from housings supported by other headpieces, including a construction for angling the blade housing and blade relative to the extending handle; adjustable thumb supporting pieces for the handles; handle adapters to reposition the handles; pistol grip handles; drive cable casing connectors; and replaceable blade housings securable to the headpieces for supporting replaceable rotary annular blades. The modular construction is designed to allow adjustment between or among parts to accommodate different physiologies of users and different modes of use and different tasks for which the assembled knife may be used. The handles provided for the modular knife are of improved shape that reduces unwanted areas of pressure concentration on the gripping hand while at the same time providing as firm a grip as possible for a given gripping force. A method of selecting the proper handle size is provided.

82 Claims, 15 Drawing Sheets

U.S. PATENT DOCUMENTS

| | | | |
|---|---|---|---|
| 4,575,938 | 3/1986 | McCullough | 30/276 |
| 4,590,676 | 5/1986 | Bettcher | 30/276 |
| 4,619,047 | 10/1986 | Heckman | 30/276 |
| 4,629,191 | 12/1986 | Mancuso | 273/81.4 |
| 4,637,140 | 1/1987 | Bettcher | 30/276 |
| 4,702,006 | 10/1987 | McCullough | 30/276 |
| 4,825,548 | 5/1989 | Driggers | 30/276 |
| 4,854,046 | 8/1989 | Becker et al. | 30/276 |
| 4,894,915 | 1/1990 | Becker et al. | 30/276 |
| 4,905,374 | 3/1990 | Schlein | 16/114 R |
| 4,928,457 | 5/1990 | Laperle | 30/276 |
| 4,941,232 | 7/1990 | Becker et al. | 16/111 R |
| 4,964,192 | 10/1990 | Marui | 16/111 R |
| 4,969,231 | 11/1990 | Mader et al. | 16/111 R |
| 5,027,591 | 7/1991 | Nakamura et al. | 30/276 |
| 5,031,323 | 7/1991 | Honsa et al. | 30/276 |

54
114
138
60
88
86
52
90
A
104
84
140

114
138
A
104
90

A 54
60
A
52
56

104
60
A
52
56

60
A
52
56

104
60
A
52
56

60
A
52
56

MODULAR POWER-DRIVEN ROTARY KNIFE, IMPROVED HANDLE AND METHOD

FIELD

This invention relates to hand held power-driven rotary knives, to an improved handle and a method of determining handle size.

PRIOR ART

Hand held power-driven rotary knives are known and find particular application in the meat processing industry. Various constructions that utilize annular blades supported for rotation in annular housings at an end of a handle are shown in such U.S. Patents as U.S. Pat. Nos. 4,439,924; 4,492,027; 4,509,261; 4,516,323; 4,590,676; 4,637,140; 4,854,046; and 4,894,915. These constructions provide a one-piece handle and head, with a replaceable housing and blade and are of different sizes and constructions to facilitate different tasks. Some knives of this type are made with a plastic handle attached to a metal headpiece that supports the blade housing and some have a removable air motor drive that forms the handle. It is known to drive the blades with motors directly attached to a headpiece or supported remote from the hand held knife and connected through a rotary flexible cable to drive the blade.

SUMMARY OF THE INVENTION

The present invention provides a set of standardized components combinable to provide a modular power-driven knife having an annular rotary blade, the structure of which knife can be varied through choice of components to accommodate different operators and different tasks. The components include plural elongated handles to accommodate different sized hands; plural headpieces, each having a transmission for driving an annular rotary blade and identical means by which any of the handles are attachable in a first orientation, and each differently constructed to support a replaceable blade housing of predetermined size and construction different from housings supported by other headpieces of the set, including a construction for angling the blade housing and blade relative to the extending handle; adjustable thumb supporting pieces for the handles; handle adapters to reposition the handles; pistol grip handles; drive cable casing connectors; and replaceable blade housings securable to the headpieces for supporting replaceable rotary annular blades. Not only can many different constructions be assembled using many of the same basic parts, resulting in lower inventory and allowing the user to take advantage of the longer useful life of some components compared to others, but also the modular construction is designed to allow adjustment between or among parts to accommodate different physiologies of users and different modes of use and different tasks for which the assembled knife may be used.

The combination of handle shapes and sizes, adjustable thumb support and adapters for orienting handles in different relationships to the headpiece and blade all work together to reduce operator stress and fatigue. The ability to orient handles in different relationship to the blade accommodates use of the knife at different work stations and for different tasks with reduced stress as compared with a straight-handled knife, where for example, the work station or product is oriented horizontally to require excessive ulnar deviation between the gripping hand and wrist with a straight-handled knife. It is recognized that ulnar deviation between the hand and wrist different from a neutral hand position that has an ulnar deviation of 7½ degrees, causes stress. The modular design allows the user to assemble different components as the user's task changes, and to adjust the components to the user's particular comfort, and thereby reduce stress that would otherwise be incurred with straight-handled conventional power-driven rotary knives of this type, all without requiring a complete complement of separate knives of various equivalent arrangements.

Each of the plural headpieces accommodates a drive transmission for the knife blade and supports a particular type and size of housing for supporting a particular type of ring blade. Further, as to each different type of housing and blade construction, different sizes of blade housings and supported blades are provided for efficient operation for different tasks. A headpiece is included that orients the blade housing and blade in a plane different from the plane provided by other headpieces and hence at a different angle with respect to the handle to reduce fatigue and stress and to improve comfort in certain operations. The preferred angled blade housing and blade lie in a plane tipped downward 15 degrees from the direction the straight handle extends, to eliminate 15 degrees of ulnar deviation between the gripping hand and wrist when the blade is used in a horizontal plane.

Handles for the headpieces are provided in different sizes and for left and right hands. Three sizes have been found to be adequate for all practical purposes. Each handle is attachable by an identical connector to any one of the headpieces and is adjustable about its longitudinal axis. This adjustment can improve the position of the cutting blade relative to the material being cut while maintaining the operator's hand, wrist and forearm in as optimum a position as possible, thereby reducing the amount of deflection and extension of the operator's wrist during use. In addition to providing a working grip for the knife, the handles receive and attach a flexible drive cable to the headpiece.

A thumbpiece separate from the headpiece and handle is provided and constructed with a base portion for support at the juncture between the two and a thumb-engaging portion extending angularly from the base portion and handle in a manner that provides an effective grip for control of the knife while also providing improved hand position that avoids so-called "lateral pinch" that occurs when the thumb and forefinger of the hand are too close together when a handle is gripped. The thumb piece is adjustable peripherally about the axis of the handle independently of the handle adjustment, thus allowing the operator to separately select both the handle adjustment and the thumb position, with relation to the cutting blade. The thumb piece can extend to either side for right or left hand use.

The thumbpiece positions the operator's thumb laterally of the handle centerline, which provides greater leverage to be applied by the thumb to the blade. Through adjustment of the position of the thumbpiece, the leverage can be directed relative to the direction of cutting, whereas previously the leverage from the thumb could only be most effectively applied in the direction of the blade axis. That was a particular disadvantage where the knife was used to cut in a sidewise direction parallel to the plane of the blade, and resulted in the need for additional gripping force applied through the fingers and palm of the hand and accompanying fatigue.

A handle adapter, also separate from the headpiece and handle, is provided, constructed with a base portion for support at the juncture between the two in a similar manner to and in place of the thumb piece. The adapter supports any of the handles for the headpieces and orients the handles in a different direction and in a different position from handles directly attached to a headpiece. In the preferred construction, the adapter locates the handle across the axis of the orientation of direct attachment, providing a so-called Tee grip, and locates the handle above the plane of the headpiece. The adapter can be rotated about the axis of a directly attached handle, and a handle attached to the adapter is adjustable about its own longitudinal axis for comfort and to properly orient the operator's hand relative to his or her forearm to minimize fatigue and stress.

A pistol grip handle is also provided, to replace the straight handle and is attached at the same place and in the same way, but has an upstanding, forwardly inclined grip extending from a tubular body that receives the cable drive for the blade. This allows an operator to grip the knife with the plane of his or her hand generally vertical in a natural and comfortable position.

A separate drive cable support is provided for use when a handle adapter is used to support the otherwise directly attached handle that has been reoriented. The drive cable support is a tubular affair that is attached to the headpiece in place of and in the same manner, location and orientation as a handle that is directly attached to the headpiece. The purpose is to receive and attach a cable to the headpiece, which cable would otherwise be received in the handle.

A conveniently insertable and removable cable casing connector is receivable in all of the handles and the drive cable support. It surrounds and attaches to a casing on the driving end of a flexible motor driven cable, allowing the driving end to extend into and drive a transmission in the headpiece, and retains the cable in engagement with the transmission during operation. In the preferred embodiment, the transmission is a pinion that meshes with gear teeth of the driven ring blade and which directly receives the end of the drive cable.

The handles of this invention are of improved shape that reduces unwanted areas of pressure concentration on the gripping hand while at the same time providing as firm a grip as possible for a given gripping force. In this way, stress and fatigue as well as overuse injury to the user is reduced, especially in repetitive operations. The handles are provided in multiple sizes, three in the preferred embodiment, to allow users with different size hands to obtain effective gripping and the full benefits of the improved shape and adjustable orientation provided by the present construction. The handles are constructed with an irregular cross sectional shape that has been found to reduce the amount of grip force required to prevent rotation of the handle within the hand during use, thereby reducing fatigue.

More specifically, the handles are constructed so the circumferences or perimeter at longitudinally spaced locations along the portion to be gripped substantially correspond to the length of the hand at the location where each gripping finger contacts the handle. In that way, each finger can effectively apply gripping pressure to the handle with substantially equal effort and pressure. The lateral side surface of the handle bulges somewhat more than the medial side surface, because the lateral side surface is received in the palm of the gripping hand and with the bulge better fills the natural pocket of the palm. This distributes the pressure between the gripping hand and the handle across and along the palm. The medial side surface has a more defined longituding rib at the widest portion of the handle, with flatter surfaces angled inwardly toward top and bottom surface portions of the handle than the lateral side, and the bottom surface has a smaller radius than the top surface. These sharper, wider areas are located to substantially coincide with the joints of the gripping fingers for even pressure distribution between the handle and the gripping fingers.

A range of major and minor cross sectional dimensions has been established for the handles and a length dimension range for the gripped portion of the handles has been determined, based on actual anthropometry measurements of hand length, palm breadth and cross corner length (which is the diagonal length along the palm that the tool handle extends when gripped) and also based on available published tables and data on hand length and palm breadth for men and women. The ranges determined have been divided into three size groups, yielding an increment of change from one size to the next. From the values of these ranges and groupings, three actual design sizes have been determined.

It has been found that the mathematical product of the measured length of the hand and width of the palm of the hand to be fit can be used to satisfactorily determine which of the three sizes is most suitable for a hand having the two measured dimensions. The full range of such mathematical products expected from a population of anticipated users has been divided into three approximately equal groups so that each group corresponds to a different handle size. For convenience, the groupings are displayed on a chart or are otherwise contained in a data base, and a selection of one of the three handle sizes designed can be made by measuring the hand to be fit, determining the product of hand length and palm width, finding the approximate same value in the groupings on the chart or in another form of data base, and selecting the handle size indicated by the data base as applicable to that grouping.

In addition to the foregoing, the invention can be characterized as encompassing the following:

(a) A set of standardized components combinable to provide a modular power-driven knife having an annular rotary blade, the structure of which knife can be varied through choice of components to accommodate different operators and different tasks, said components comprising plural elongated handles to accommodate different sized hands, plural headpieces each having a transmission for driving an annular rotary blade and identical means by which any of the handles are attachable in a first orientation and each differently constructed to support a replaceable blade housing of predetermined size and construction different from housings supported by other headpieces of the set, and replaceable blade housings securable to the headpieces for supporting replaceable rotary annular blades.

(b) A knife having a power-driven annular rotary blade and including a blade housing, a headpiece and a handle, said handle having a non-circular external contour in cross section, and said headpiece comprising a body having a front end supporting the blade housing, a rear end removably securing the handle, a through passage opening through the front and rear ends, and a transmission in said passage for driving said blade, said rear opening being adapted to receive means for driving said transmission, and means securing the handle at one end to the headpiece for rotational adjustment relative thereto in predetermined fixed increments about a central longitudinal axis of the passage.

(c) A knife having a power-driven annular rotary blade and including an elongated handle having a longitudinal central axis and an annular blade housing a face of which defines a plane, said housing secured to said handle and having a central axis perpendicular to said plane and located in a plane common to the longitudinal central axis, the plane of said housing being oriented relative to the longitudinal central axis so as to intersect the axis, and the central axis of the housing intersecting the longitudinal axis at an acute angle.

(d) A thumb piece for a knife having a power-driven annular rotary blade carried by a housing that extends from a support that includes an elongated handle, said thumb piece including means for securing said thumb piece at one end thereof to the support, and an elongated concave thumb-engaging blade extending from said securing means in cantilever fashion in a relationship thereto that establishes an acute angle between the thumb-engaging blade and the direction of elongation of the handle, when the thumb piece is secured to the support.

(e) A handle adapter for a rotary knife having a power-driven annular blade, said adapter having means for attachment to a headpiece that supports the blade, an arm extending from said means, and means at a distal end of the arm to attach an elongated handle.

(f) A handle for a working element, said handle being generally elongated and adapted to be gripped in one hand, and having longitudinal portions including a first portion adjacent one end and adapted to be connected to the working element, a second portion adjacent an opposite end of the handle, and a third portion between the first and second portions, all three portions adapted to be gripped, the first and second portions each being substantially circular in cross sectional contour and of smaller cross sectional area than the third portion, and arcuate longitudinal surface transitions between adjacent first and third, and second and third, portions, said third portion having an upper surface constructed to face and contact the palm of a gripping hand, a lower surface constructed to face and contact finger portions of a gripping hand, a side surface constructed to face and contact the palm adjacent the proximal ends of the fingers of a gripping hand, and a medial side surface constructed to face and contact the distal ends of the fingers of a gripping hand, said third portion having a cross sectional shape that has an arcuate upper surface, an arcuate lower surface of smaller radius than the upper surface, and flat downwardly converging sides in part forming a lower half, and the longitudinal contour of said third portion being straight along a horizontal midplane and convexly curved along a vertical midplane.

(g) A method of selecting the size of a handle to fit a hand where the handle comes in a limited number of predetermined sizes that vary in both length and circumference, the range of sizes being selected to fit hands of different overall length, palm breadth, palm length, and cross corner length, the steps comprising, measuring the overall length of the hand to be fit, measuring the width of the palm of the hand to be fit, determining the product of the two measurements, providing a data base in which each handle size is related to a range of indicia that represent the products of the two measurements and the range is based on measurements taken from populations having hand sizes typical of users of the handles, and finding an indicium in the data base that represents the closest product to that of the two measurements made of the hand to be fit and selecting the size indicated by that indicium.

(h) A power driven rotary knife comprising a headpiece that supports a rotary annular cutting blade in a horizontal plane, an arm extending laterally and upwardly from the headpiece, laterally with respect to a vertical plane through the center of the annular blade and upwardly with respect to the horizontal plane, said arm terminating at a distal end in means for supporting a handle by which the knife can be gripped for use, a handle secured to said means at the distal end of the arm and extending transversely with respect to said vertical plane, and means extending from the headpiece for securing a drive means to the knife for rotating the annular blade.

(i) A power driven rotary knife comprising a headpiece that supports a rotary annular cutting blade in a horizontal plane, an elongated handle having a tubular portion extending generally horizontally from said headpiece rearwardly from the cutting blade and a hand grip portion extending upwardly from the tubular portion and inclined forwardly toward the annular cutting blade, and means in the tubular portion for supporting means to rotate the blade.

(j) A cable casing connector for a rotary knife having a tubular handle with an open end and an annular cutting blade driven by a rotary flexible cable within a flexible casing that extends within the handle, said cable casing connector constructed to be received in said handle for limited axial and rotational movement relative to the handle, said cable casing connector being tubular and including means to receive a flexible drive cable in fixed axial relationship and extending through front and rear ends, and a guide slot in an external surface of the cable casing connector, opening through the front end thereof, extending axially along the connector from the opening for less than the entire length of the connector then extending peripherally and then extending axially toward the front end and terminating short of the front end, said guide slot being adapted to receive a radially extending projection within the handle.

Thus, objects of this invention are to provide a set of components combinable to provide a modular power-driven knife, to provide power-driven knives with improved structural features, to provide an improved handle for a hand held implement, and to provide a method for determining the size of a handle that best fits the hand of a particular user.

The above and other features of the invention will become better understood from the detailed description that follows, when considered in connection with the accompanying drawings.

BRIEF DESCRIPTION OF THE DRAWINGS

FIGS. 25-27 are bottom plan views of the knife of FIG. 2, illustrating the manner in which the thumb piece and handle are assembled to a headpiece;

FIGS. 27-32 are top plan views similar to FIG. 1, illustrating the manner in which the position of the handle relative to the headpiece can be adjusted;

BEST MODE FOR CARRYING OUT THE INVENTION

Figure 1:
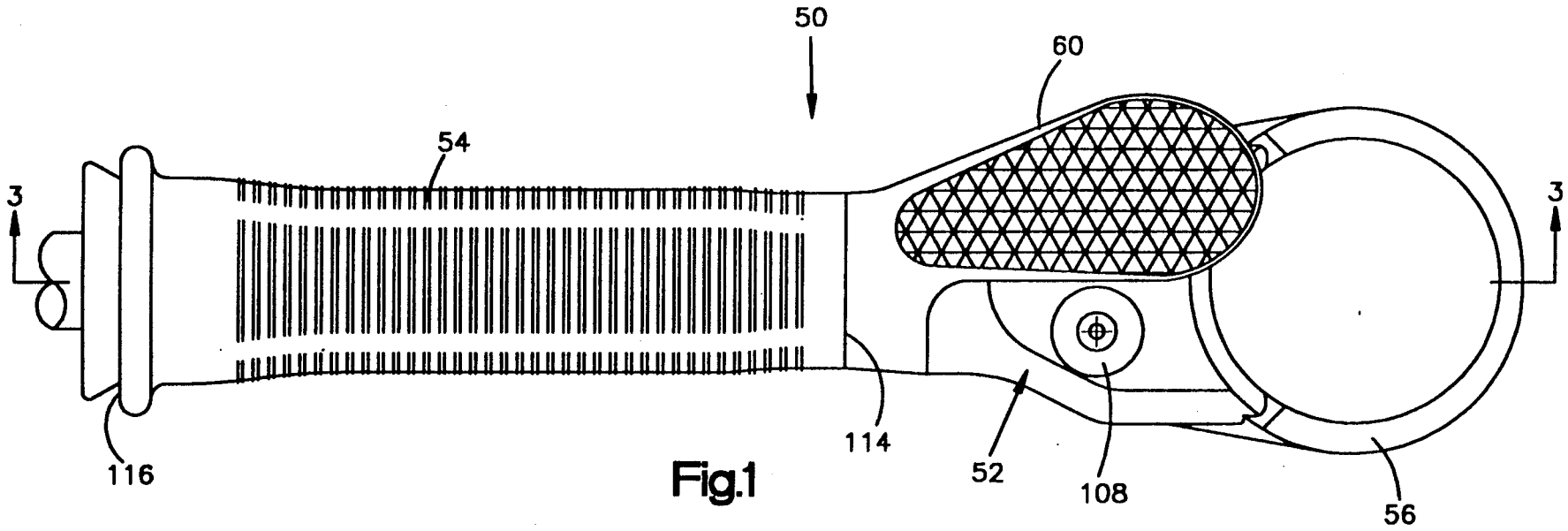
FIG. 1 is a top plan view of a modular power-driven knife constructed in accordance with the present invention.
Figure 2:
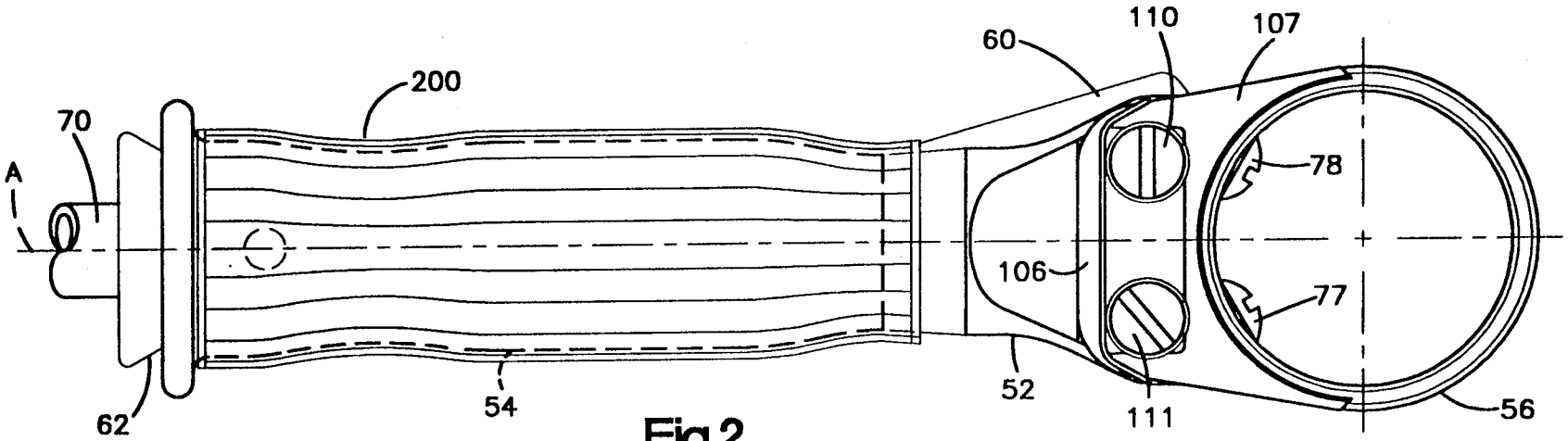
FIG. 2 is a bottom plan view of the knife of FIG. 1, showing a tubular rubber grip on the handle of the knife.
Figure 3:
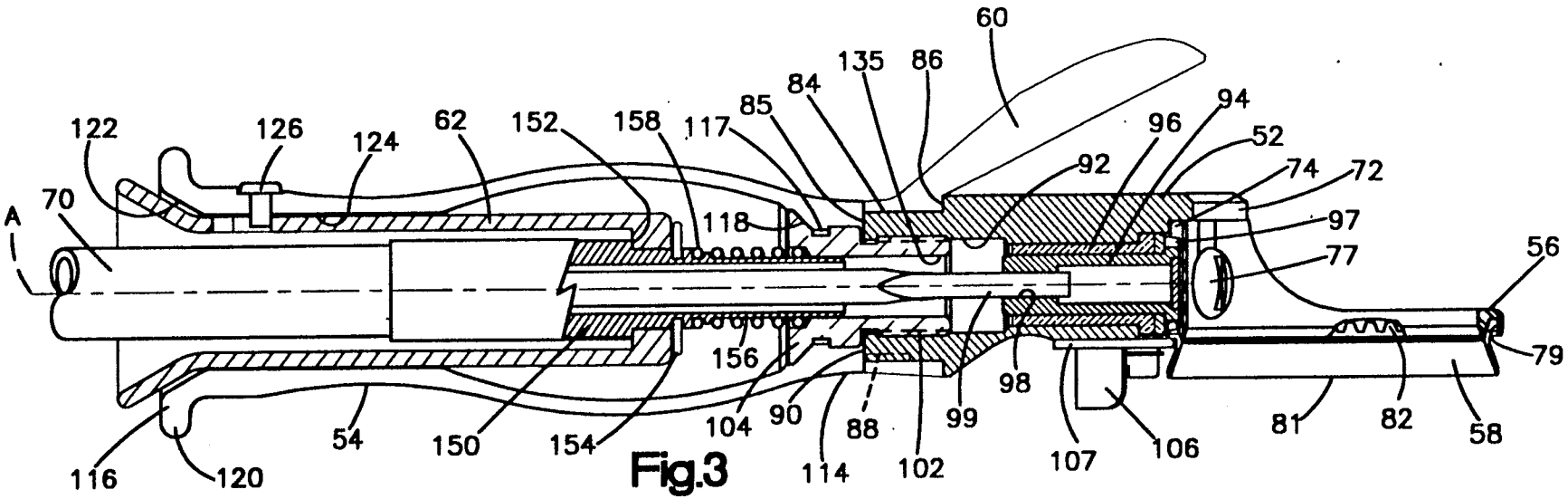
FIG. 3 is a longitudinal sectional view taken along the line 3—3 of FIG. 1.
Figure 17:
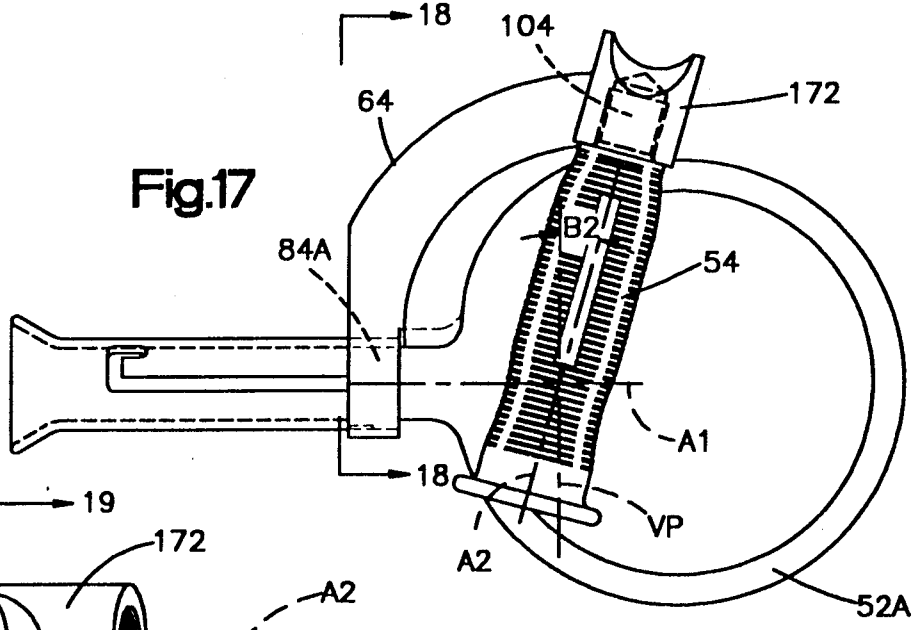
FIG. 17 is a top plan view of a modular knife, handle adaptor, and reoriented handle.
Figure 20:
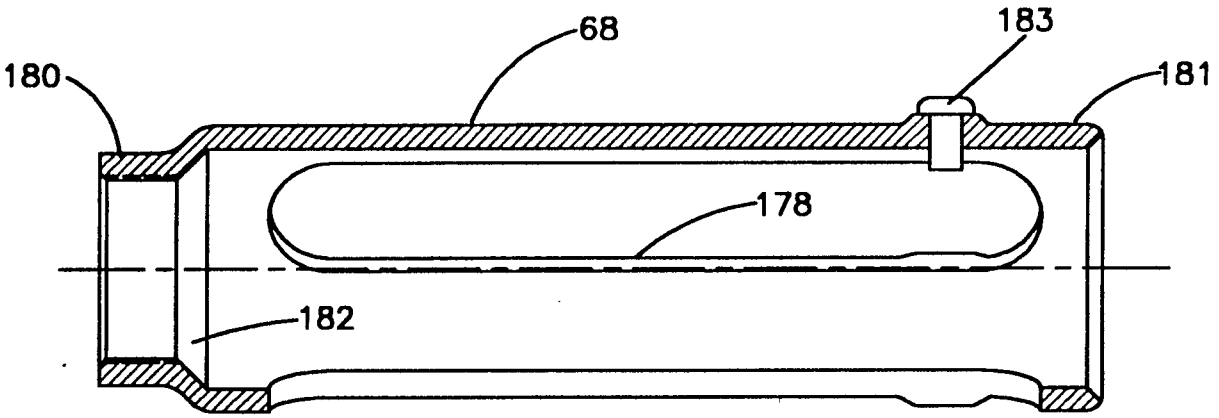
FIG. 20 is a longitudinal sectional view of a drive cable support attachable to a headpiece.

One preferred construction of a knife assembled from standardized, i.e., compatible, components is shown in FIGS. 1-3. The knife 50 is comprised of the following principal separable components: a headpiece 52, a handle 54, a blade housing 56, a blade 58, a thumb piece 60 and a cable casing connector 62. Other somewhat differently constructed headpieces 52A, 52B, 52C and associated blade housings and blades, as illustrated by way of example in FIGS. 10-13 and 17, can be used in place of the headpiece 52 with the same other components. Also, as illustrated in FIG. 17, a handle adapter 64 can be substituted for the thumb piece 60 to support the same handle 54 in a new position relative to any of the headpieces, transversely of and in a different plane from the original handle position. Alternatively, an entirely different pistol grip handle 66 (FIGS. 33-35 can be substituted for the original handle and thumb piece on any of the headpieces. As illustrated in FIGS. 17 and 20, when the adapter 64 is used to reposition the handle 54, a drive cable support tube 68 is attached to the headpiece in the previous location of the handle 54 to receive the cable casing connector 62 that is otherwise received in the handle 54. The drive cable support and the cable casing connector locate and connect a drive cable 70 with respect to the headpiece in an identical manner to that of the handle 54.

Handles 54 of different sizes can be used with the same headpiece and other components to accommodate operators with different sized hands. In all instances, the handles, thumb piece and handle adapter are rotatably adjustable relative to the headpiece to permit an operator to achieve as comfortable hand and wrist position as possible for any particular task.

The manner in which the principal components are constructed and connected to form a complete knife with a longitudinally extending handle is best shown in FIGS. 1-3.

The headpiece 52 has a front end 72 with a partial cylindrical face 74 that locates and supports the ring blade housing 56, attached by two screws 77, 78. In turn, the ring blade housing supports a ring blade 58 in a groove 79 for relative rotation in a manner known in the art. The blade is outwardly flared and terminates at one axial end in a cutting edge 81 and has a ring gear portion 82 at the other axial end that is received in the groove and by which it is driven in rotation.

A cylindrical boss 84 is at the rear end 85 of the headpiece and forms a shoulder 86. Axially extending grooves 88 are formed in a portion of the outside surface of the boss 84 to locate the thumb piece or handle adapter. Similar grooves 88*a* are better shown in FIG. 10 in connection with the headpiece 52A. The grooves open through a flat end surface 90 of the boss and terminate short of the shoulder 86.

A straight throughbore 92 circular in cross section extends from the rear end 85 to the front end 72, opening through the surfaces 90 and 74. A pinion gear 94 in the throughbore adjacent the front end 72 is supported for rotation in a bearing 96 and has teeth 97 that mesh with the ring gear portion 82 to drive the blade 58. A central passage 98 in the pinion body is square in cross section and slidably receives a square cross sectional end 99 of the rotary drive cable 70. The throughbore 92 has threads 102 adjacent the end surface 90 to receive a tubular connector insert 104 (shown in detail in FIGS. 23 and 24) that attaches the handle 54 to the headpiece.

A finger guard 106, blade retaining yoke 107 and grease cup 108 are supported by the headpiece. The finger guard and yoke are attached by screws 110, 111. The guard inhibits movement of an operators fingers into the blade. The manner in which the yoke removably retains the blade is shown in FIGS. 2 and 3 and in U.S. Pat. No. 4,637,140.

The handle 54 is hollow and open at both a front end 114 and a rear end 116 and has an irregular external contour both longitudinally and in cross section as illustrated in FIGS. 1-9. The front end 114 is flat and annular in cross section and slightly larger in outside diameter than the flat end surface 90 of the boss 84, against which it abuts. The front end has internal splines 117 that terminate inwardly adjacent a flared locating surface 118. The length of the splines is significantly less than the axial extent of the threads 102 internally of the boss 84. The splines and locating surface cooperate with the tubular insert 104, which is received in the front end of the handle. The rear end 116 has an external flange 120 and the inside contour has an outwardly flared portion 122 at the rear opening and an adjacent and substantially longer cylindrical portion 124 inwardly thereof that supports the cable casing connector 62 in which the drive cable 70 is secured. The cable casing connector is removably retained by an inwardly extending pin 126.

Figure 24:
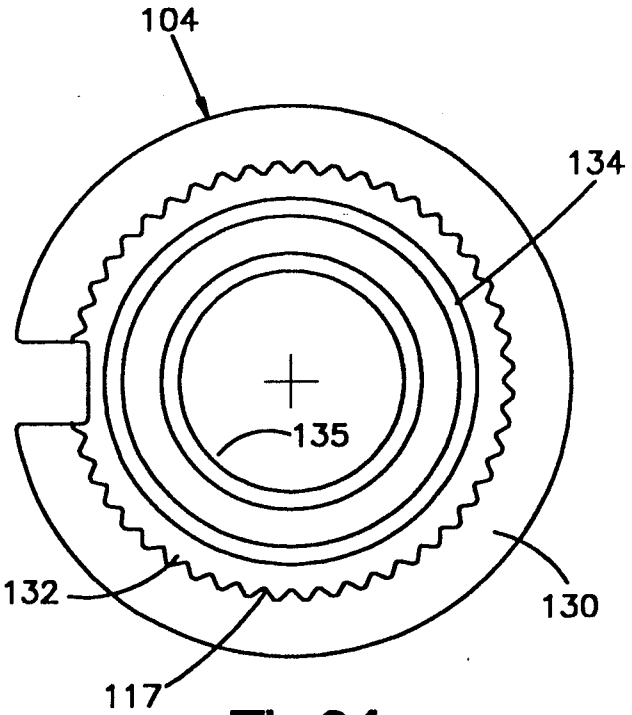
FIG. 24 is an end elevational view of the hand connector of FIG. 23, viewed from the plane of the line 24—24 of FIG. 23.
Figure 23:
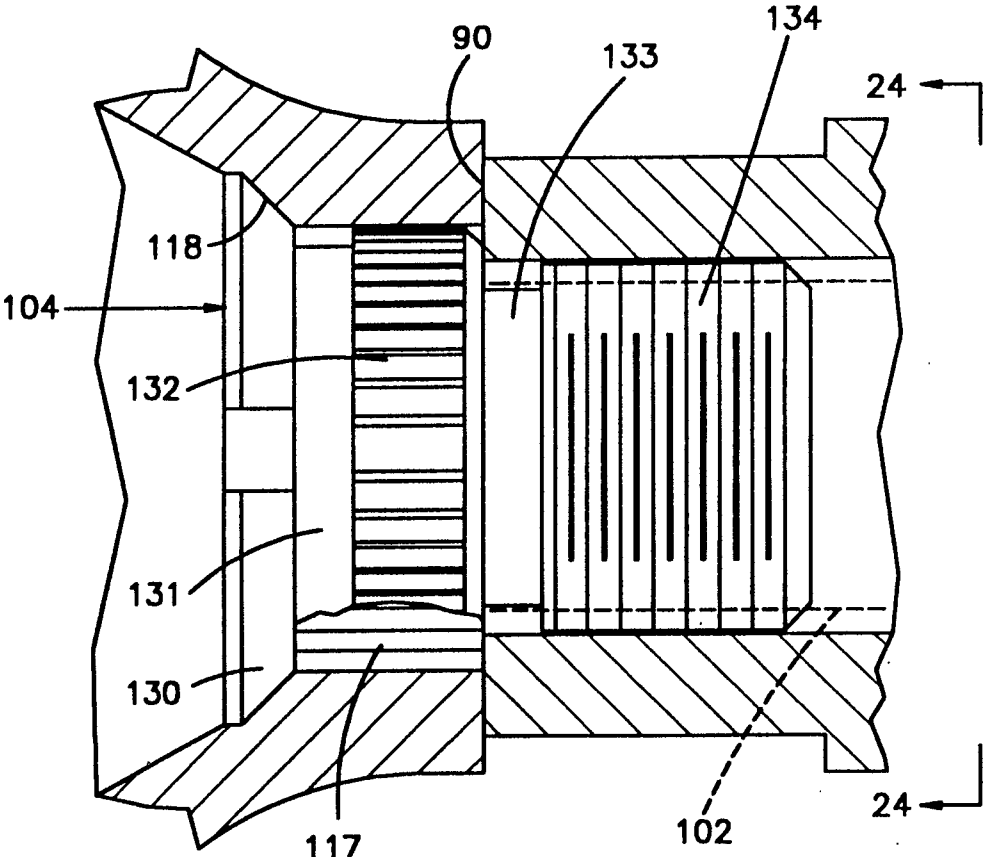
FIG. 23 is a side elevational view of a handle connector for securing a handle to a headpiece.

The construction of the tubular connector insert 104 is best shown in FIGS. 3, 23 and 24. It is circular and annular in cross section and has, at one end a flared head 130, an adjacent intermediate portion 131 with small splines 132, and terminates at its other end in a smaller diameter portion 133 that has an external thread 134. It has a straight central passage 135 that is circular in cross section and of a sufficient diameter to receive the driving end of the drive cable 70. The axial length of the splines is substantially less than that of the threaded portion. The connector insert not only serves to secure the handles 54, the pistol grip 66 and the tubular drive cable support 68 to any of the headpieces, but it also permits a positive rotational adjustment of the handles relative to the headpiece and, hence, relative to the cutting blade of the knife.

Figures 25, 26, 27, 28, 29, 30, 31, 32:
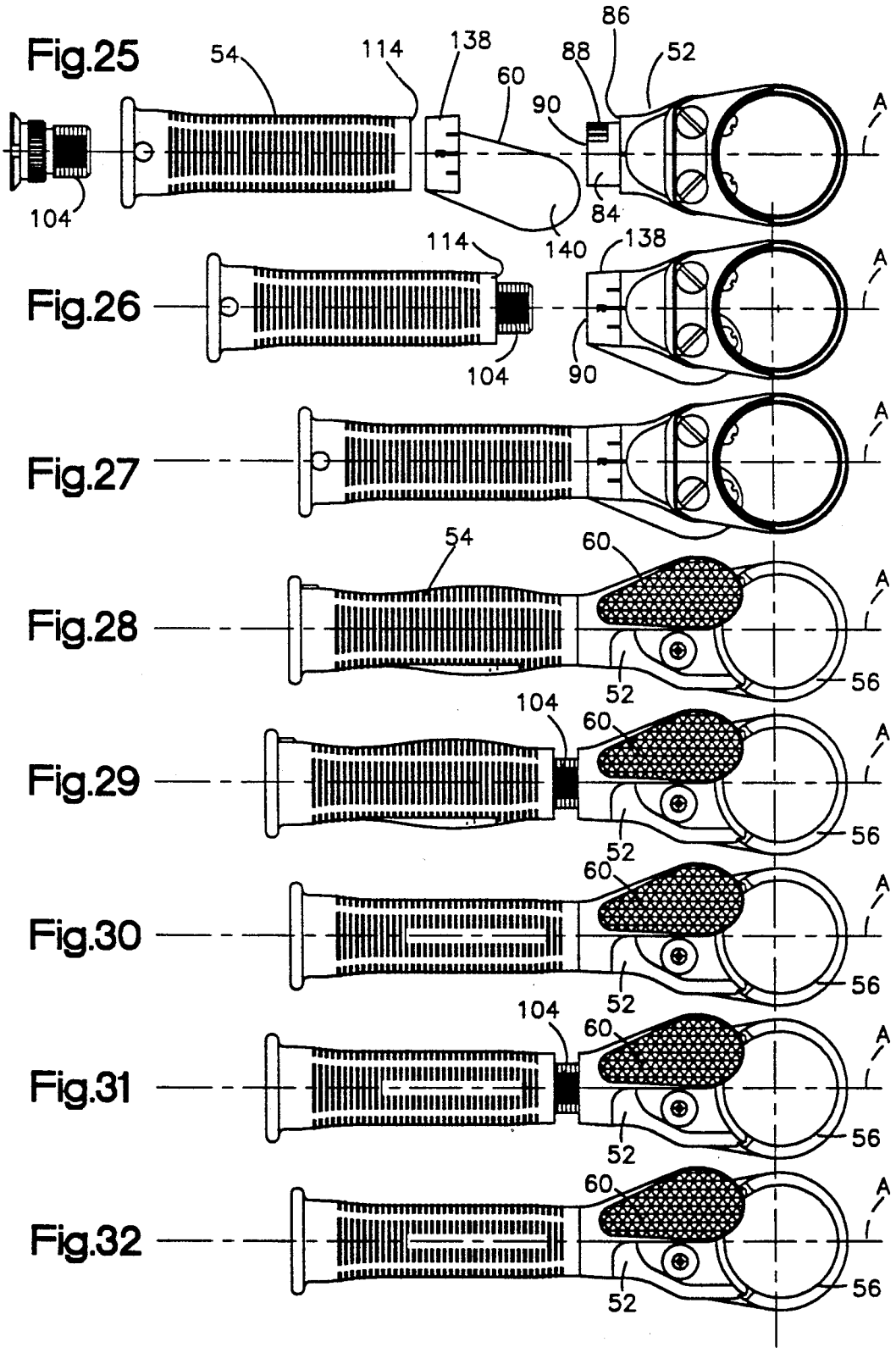

As best shown in FIGS. 3 and 23, when the handle 54 is in the position shown, firmly against the flat end surface 90 of the headpiece, the flared head 130 of the insert 104 is against the internal flared locating surface 118 of the handle, the splines 132 of the insert are engaged with the splines 117 of the handle and the threads 134 of the insert are engaged with the threads 102 of the headpiece. Rotation of the handle relative to the headpiece is prevented except by unscrewing the handle and insert from the headpiece and thus the orientation of the handle is maintained in use. Adjustment of the orientation of the handle about its central longitudinal axis A is illustrated in FIGS. 28-32 and will be best understood in connection with the structure shown in FIGS. 3 and 23. FIG. 32 shows a final desired orientation of the handle and is the orientation shown in FIGS. 1-3. To obtain that orientation from an original orientation illustrated in FIG. 28, the handle 54 is rotated to partially unscrew the threaded portion 134 a distance slightly greater than the length of the splines 117 of the handle, all the while pulling on the handle to keep the splines of the insert engaged. The handle is then turned further until it is in the corresponding position that it started in. This condition is illustrated in FIG. 29. The handle is then pushed forward against the end surface 90 of the headpiece, disengaging the splines of the handle and insert, and is then rotated relative to the insert and headpiece to the orientation desired, as illustrated in FIG. 30. The handle is then pulled back axially to re-engage the splines, as illustrated in FIG. 31, and then the handle and insert are rotated together to tighten the handle against the surface 90 of the headpiece, resulting in the desired adjusted position illustrated in FIG. 32. Because there are a large number of small splines, it is possible to make small adjustments to the handle orientation and achieve the position desired.

The construction of the thumb piece 60 is best shown in FIGS. 1, 3, 14-6 and 25-27. It is a unitary piece having a cylindrical ring-like base or mounting portion 138 from which a cupped blade 140 extends at an acute angle B to the central axis of the base. The concave or cupped surface 141 of the blade that receives the operator's thumb is knurled. The cylindrical base has an axial dimension equal to the axial distance between the shoulder 86 and the front end 114 of the handle 54 so that when it is received over the boss 84 it is confined axially, as shown in FIG. 3. The ring-like base has an axially extending spline or key 144 on the inside, diametrically opposite the location of the blade 140 and directly adjacent a rear end 146 of the base and extending only partially along the axial length of the base (approximately one-half the length in the embodiment shown). The key 144 is receivable in any one of several (for example, five) grooves 88 (or grooves 88*a*, FIG. 10) in the outer surface of the boss 84 (or 84*a*, FIG. 10). The peripherally spaced grooves permit the blade of the thumb piece to be located at different positions about the longitudinal axis of the handle and headpiece to accommodate different thumb positions. While not shown, additional grooves of the same construction but diametrically opposite those shown can be provided to allow the thumb piece to be moved to a location on the opposite side of the centerline of the knife for left handed use, or a separate headpiece with appropriately located grooves can be used with the same thumb piece, as where the construction of the headpiece lends itself best to use only in one hand or the other. The manner in which the thumb piece is assembled onto the headpiece and secured by the handle is illustrated in FIGS. 25-27 of the drawings. Thereafter adjustment of the thumb piece is achieved by loosening the handle enough to move the front end 114 away from the end surface 90 of the boss 84 a distance slightly greater than the axial length of the key 144. The thumb piece is then moved away from the shoulder 86 enough to slide the key out of the groove 88 it is in. The thumb piece is then rotated on the boss 84 to the desired position and moved axially forward against the shoulder 86, placing the key in a new slot, and the handle is tightened.

The centerline of the blade portion of the thumb piece extends in an axial plane of the base and when the base is positioned to locate the thumb piece blade portion to one side of the centerline A of the assembled knife, the thumb piece comfortably receives the operator's thumb and enhances the gripping of the handle and manipulation of the knife. In the preferred embodiment, the angle B is between 25 and 30 degrees, and most preferably is about 27 degrees. This angle maintains the thumb enough outwardly of the index finger to avoid lateral pinch.

Figure 21:
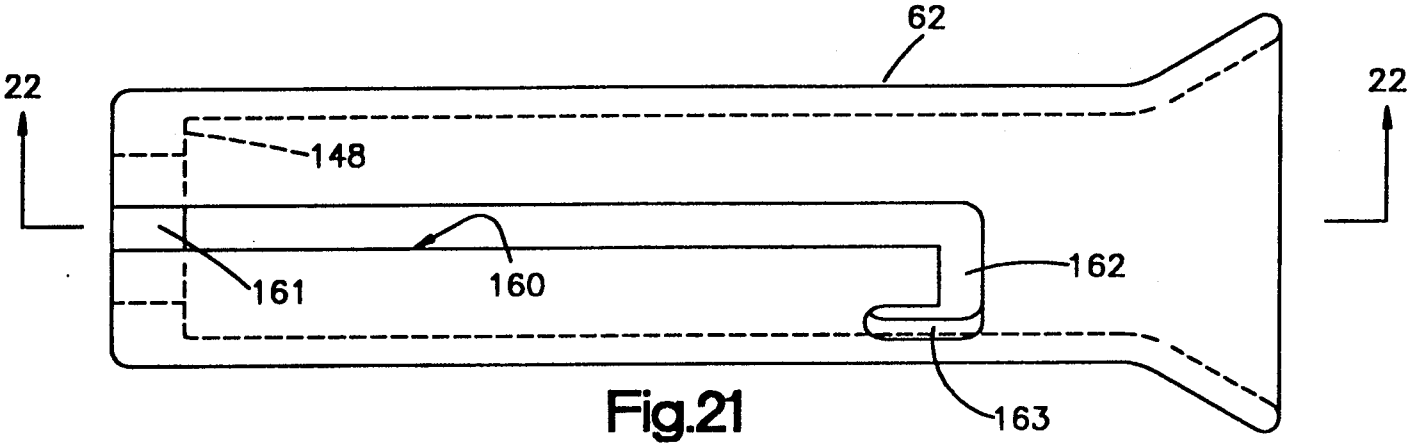
FIG. 21 is a top elevational view of a cable casing connector constructed in accordance with the present invention.
Figure 22:
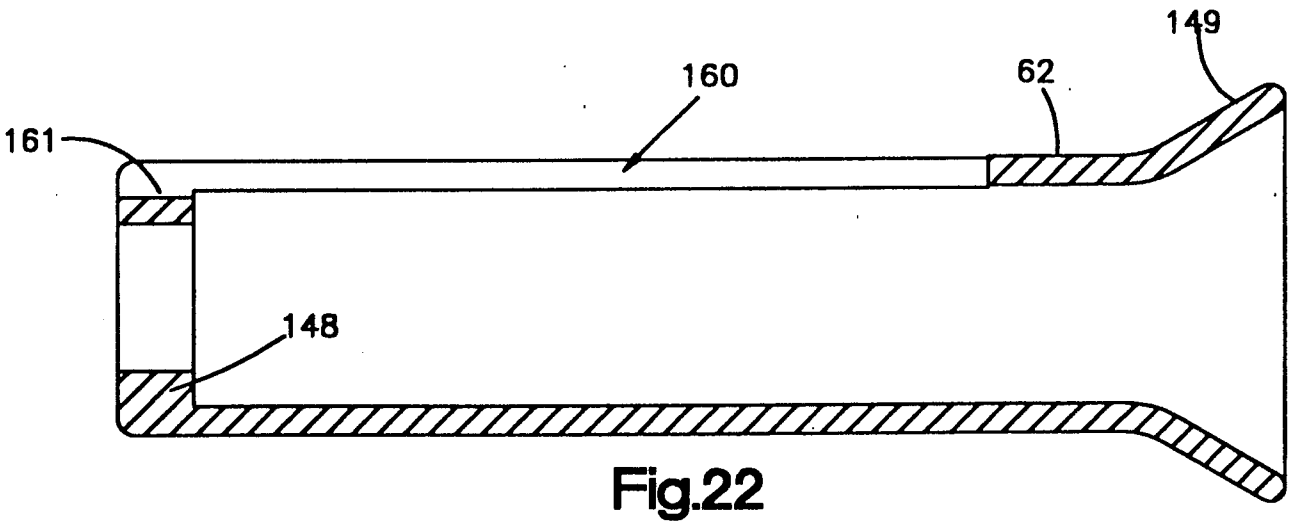
FIG. 22 is a longitudinal sectional view taken along the line 22—22 of FIG. 21.

The cable casing connector 62 (shown in detail in FIGS. 21 and 22) is a cylindrical tube with an inturned flange 148 at a front end and a flared skirt 149 at the back end for receiving an end fitting 150 (FIG. 3) of the casing of the flexible drive cable 70. The fitting in part extends through the front end of the cable support and has a shoulder 152 that abuts the flange 148, limiting forward movement. A retaining ring 154 is secured to the fitting outside of the cable casing connector, in contact with the front end, to limit relative rearward movement. A nose portion 156 of the fitting extends into the tubular connector insert 104 and the cable drive end 99 extends through it and into the pinion gear 94. A compression spring 158 acts between the nose portion and the tubular connector insert to urge the cable support rearwardly of the handle. The cylindrical exterior surface of the cable casing connector fits closely but slidably within the cylindrical portion 124 of the inside of the handle 54. As shown in FIGS. 3, 21 and 22, a guide slot 160 is formed in the cylindrical tube that forms the cable casing connector and the pin 126 extends into the slot. The slot starts with a groove 161 at the front end due to the greater wall thickness at the flange 148, extends longitudinally, and then terminates in a hook portion 162. The length of the groove and the position of the pin are such that upon insertion of the cable casing connector into the handle 54 or any handle or dummy handle of the set of component parts, the spring 158 on the end fitting of the drive cable will be compressed enough when the pin reaches the rear end of the slot that it will remain compressed when the cable casing connector is rotated to bring the pin into the hook portion and will move the cable casing connector rearwardly when the pin is aligned with a terminal portion 163 of the slot and keep the cable casing connector securely within the handle.

Figure 18:
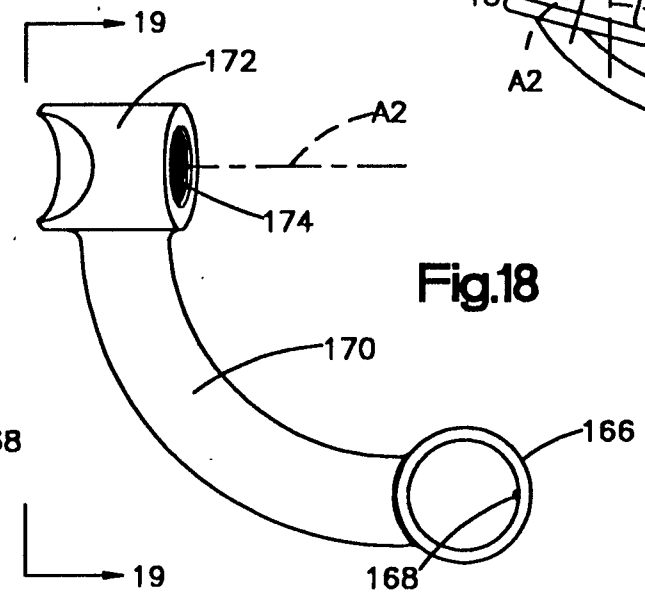
FIG. 18 is an end elevational view of the adaptor as viewed from the line 18—18 of FIG. 17.
Figure 19:
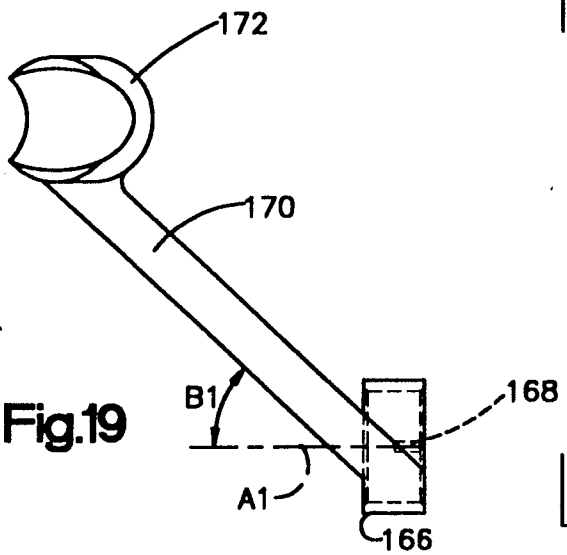
FIG. 19 is a side elevational view of the handle adaptor as viewed from the plane indicated by the line 19—19.

The handle adapter 64 is shown in detail in FIGS. 17–19 and has a cylindrical ring-like base portion 166 with a spline or key 168 on the inside surface of essentially identical construction to that of the thumb piece and which allows rotational adjustment of the adapter about the rearwardly extending boss of any of the headpieces. As shown in FIG. 17, the adapter 64 is secured to the boss 84*a* of the headpiece 52A. An integral arm 170 extends from the base portion. As shown in FIGS. 17 and 18, the arm curves forward, upward and laterally outward from the base, and as shown in FIG. 19, the arm in side elevation extends in a straight line at an angle B1 from the central longitudinal axis A1 of the base cylinder. Preferably the angle B1 is between 40 and 45 degrees, and in the preferred embodiment shown is 43 degrees. The arm terminates at its distal end in a handle mounting 172 that has a threaded bore 174 having a central axis A2 in a plane parallel to the plane of the headpiece 52A and at an angle B2 with a vertical plane VP perpendicular to the central axis A1, in the orientation of the drawings. Preferably the angle B2 is 15 degrees. The threaded bore 174 receives the tubular adapter 104 to secure a handle 54 in the same adjustable way as does the threaded boss 84 or 84A so as to allow rotation of the handle 54 about its longitudinal axis relative to the support. With the adapter 64, the knife can be gripped from above the blade, with the hand, wrist and forearm in a natural and comfortable position, especially suitable for drawing the blade toward the operator.

When the adapter 64 is used, there is no need for a handle 54 to be attached to the boss 84*a*, and instead the tubular drive cable support 68 is attached to receive the cable casing connector to secure the drive cable 70 to the headpiece. The tubular drive cable support 68 is shown in detail in FIGS. 21 and 22. It is tubular, either cut out as at 178, or solid walled, open at a front end 180 and a rear end 181. The front end is constructed with a flared inner surface 182, and the open front end and flared surface cooperate with the tubular connector insert 104 by which the drive cable support is secured to the boss 84A or the boss of any headpiece in the same manner as the handle 54. Rotational adjustment is of no siqnificance for the drive cable support. The rear end 181 is constructed to receive the cable casing connector 62 in a similar manner to that of the handle 54, and a pin 183 extends inward to retain the cable casing connector.

Figure 33:
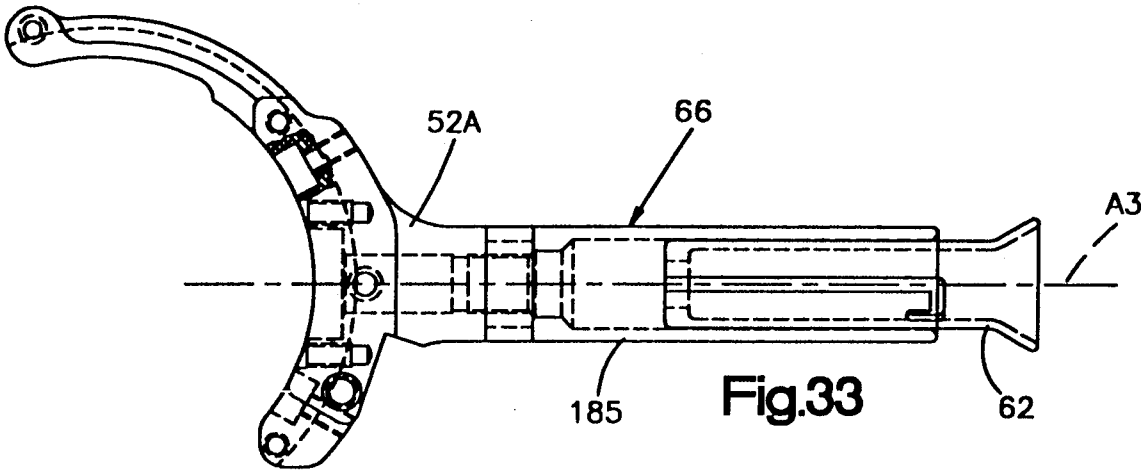
FIG. 33 is a bottom plan view of a headpiece and pistol grip handle constructed in accordance with the present invention.
Figure 34:
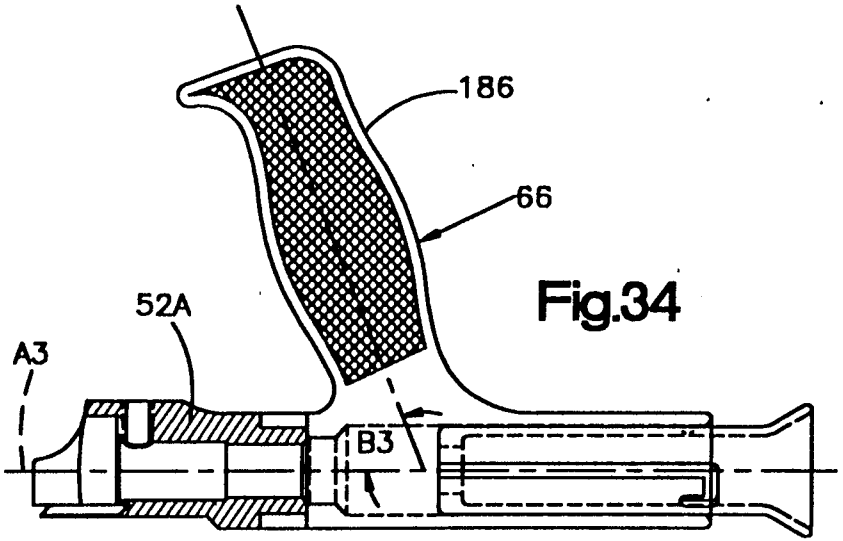
FIG. 34 is a side elevational view of the headpiece and handle of FIG. 33.
Figure 35:
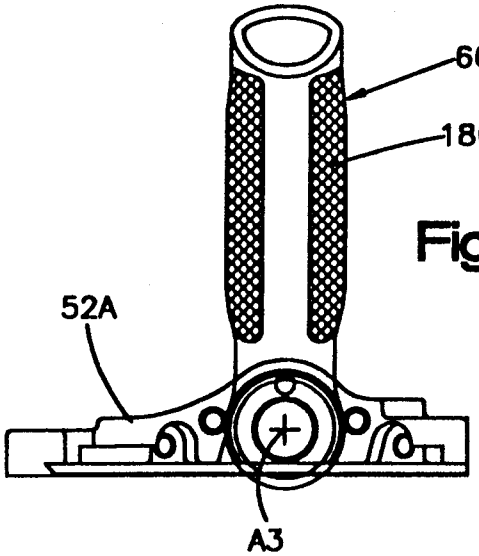
FIG. 35 is an end elevational view of the handpiece of FIG. 34, viewed from the left hand side; and, FIG. 36 is a depiction of a handle size selection chart.

The pistol grip handle 66 is shown in detail in FIGS. 33–35 attached to a headpiece 52A, shown but with the blade housing and blade removed for ease of illustration. The pistol grip has a tubular body 185 constructed internally similarly to the handle 54 except that the inside cavity is essentially cylindrical rather than following an irregular outside contour as in the handle 54 and an internally threaded boss (not shown) extends upward from the tubular body to receive a tubular connector insert 104 for adjustably securing a hand grip 186 to the tubular body. Hence, the pistol grip handle is secured to the headpiece by a tubular connector insert 104 for rotational adjustment about its longitudinal central axis A3 relative to the headpiece, and receives the cable support 62, in the same manner as the handles 54, and the hand grip 186 is rotationally adjustable about its longitudinal axis relative to the tubular body 185 in the same manner. The upwardly extending (in the orientation of the drawings) hand grip 186 is aligned with the longitudinal axis A3 and is tilted forward at an angle B3.

Preferably the angle is between 70 and 80 degrees and in the embodiment shown is 75 degrees. This grip allows an operator to grip the knife above the plane of the headpiece and with the plane of the palm of the hand substantially vertical in a comfortable and natural position, i.e., in a desired neutral state with an ulnar deviation of approximately 7½ degrees relative to the wrist, and is particularly useful when the knife is moved in a motion horizontally during a cutting or trimming operation, e.g., on a horizontally oriented product surface. The details of the irregular shape of the handles 54 are shown in FIGS. 4–9 of the drawings. The shape has been constructed to provide effective gripping without undue pressure points or grip force that results in premature fatigue and injury from overuse and repetitive tasks. While the outside contour of the handles varies with the three sized utilized in the preferred embodiments, due to the need to maintain a certain minimum internal cross sectional diameter for the working parts, the difference is primarily between the minimum and maximum cross sectional dimensions and not the cross sectional shapes. For example, the handle 54 shown in FIG. 1 is of smaller size than the handle shown in FIG. 5, accounting for a slight difference in the magnitude of the side contour variations.

Figure 4:
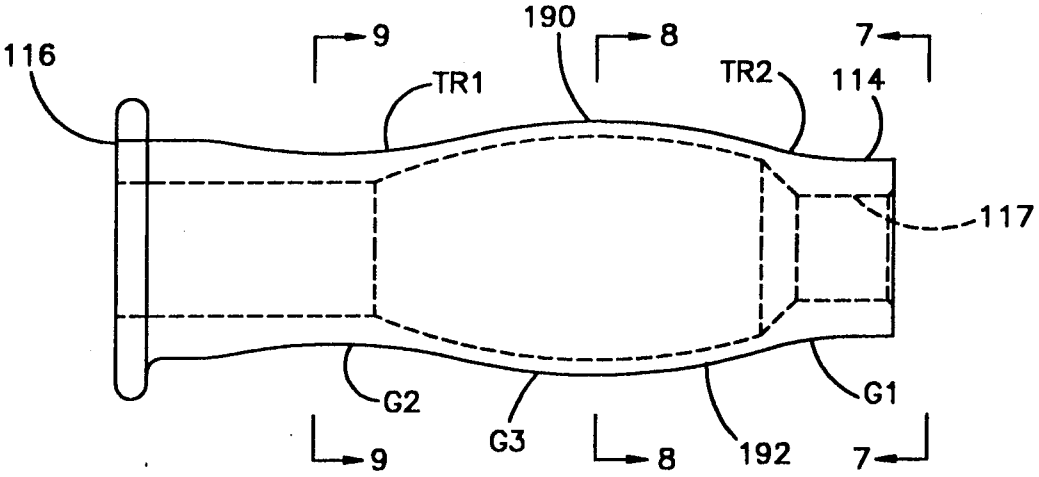
FIG. 4 is a diagrammatic side elevational view of a handle of the type shown in FIG. 3, showing the contour.
Figure 5:
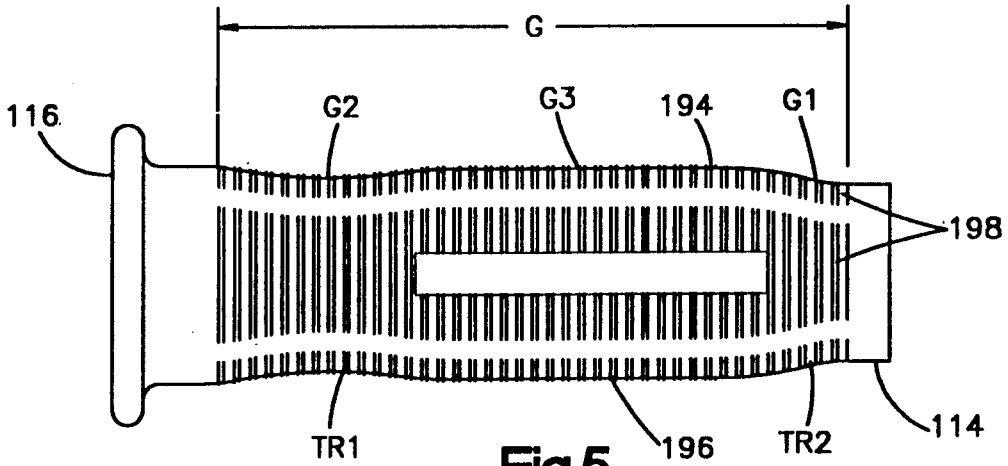
FIG. 5 is a view of the top surface of the handle shown in FIG. 4, illustrating the side contours.
Figure 6:
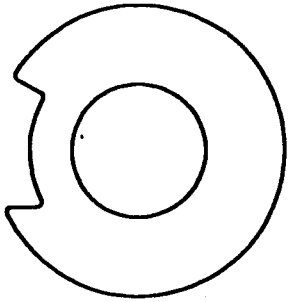
FIG. 6 is an end elevational view of the handle of FIG. 5, viewed from the left hand side.

FIG. 4 shows the external contour of a handle 54 in side elevation when oriented in substantially the recommended position of use, and FIG. 5 shows the external contour in top plan when so oriented. The longitudinal area intended to be gripped is indicated at G in FIGS. 4 and 5. Within that area there are three distinct longitudinal portions, a first portion G1 adjacent the front end 114, a second portion G2 adjacent the rear end 116, and a third portion G3 between the two portions G1 and G2. The first and second portions G1 and G2 are substantially circular in external cross sectional contour and are of smaller cross sectional area than the third portion G3. As best shown in FIG. 4, there are concave arcuate longitudinal surface transitions TR1 and TR2 of different radii between the first and third and between the second and third portions, the radius of portion TR1 being smaller than that of TR2, approximately half as great in the preferred embodiment. The external contour of upper and lower surfaces 190, 192, respectively, between the transitions is convex and also arcuate, with a radius greater than that of the transitions.

The contour of side surfaces as viewed from top plan is shown in FIG. 5. The third portion G3 is substantially straight on both a medial side surface 194 and a lateral side surface 196 between the transitions TR1 and TR2.

Figure 7:
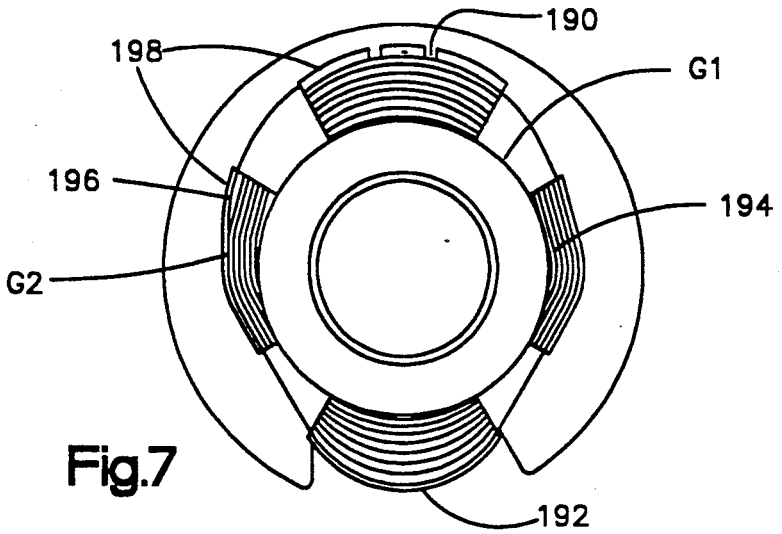
FIG. 7 is an end elevational view of the handle of FIG. 4, viewed from the plane indicated by the line 7—7 of FIG. 4.
Figure 8:
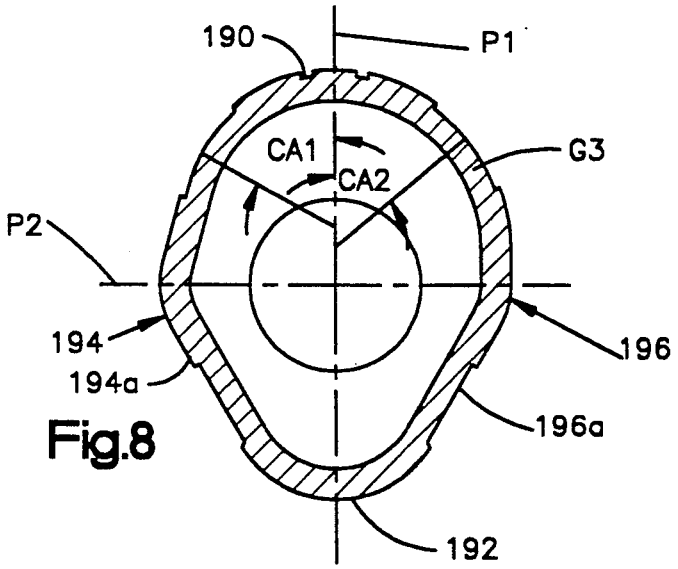
FIG. 8 is a cross sectional view of the handle of FIG. 4, taken along the line 8—8.
Figure 9:
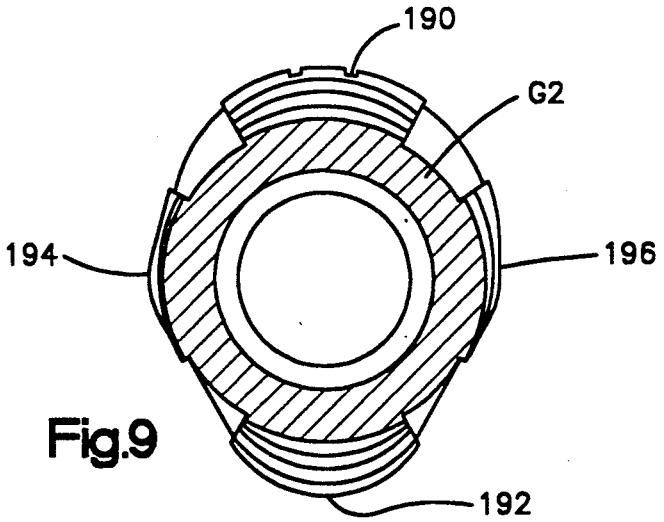
FIG. 9 is a cross sectional view of the handle of FIG. 4, taken along the line 9—9.
Figure 11:
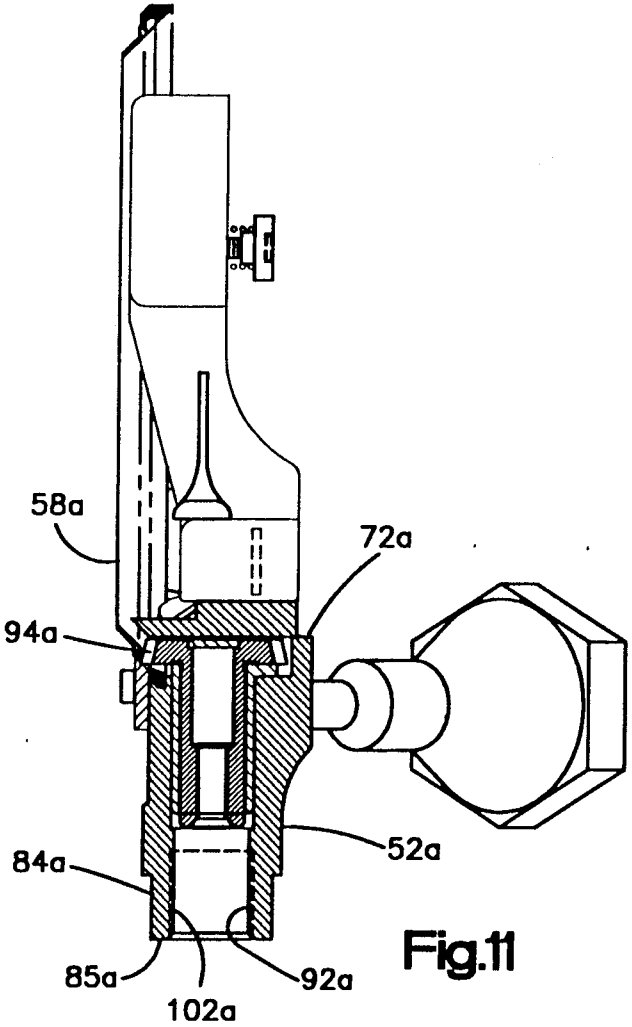
FIG. 11 is a view, partially in longitudinal section and partially in elevation, of the headpiece of FIG. 10, taken along the line 11—11.
Figure 10:
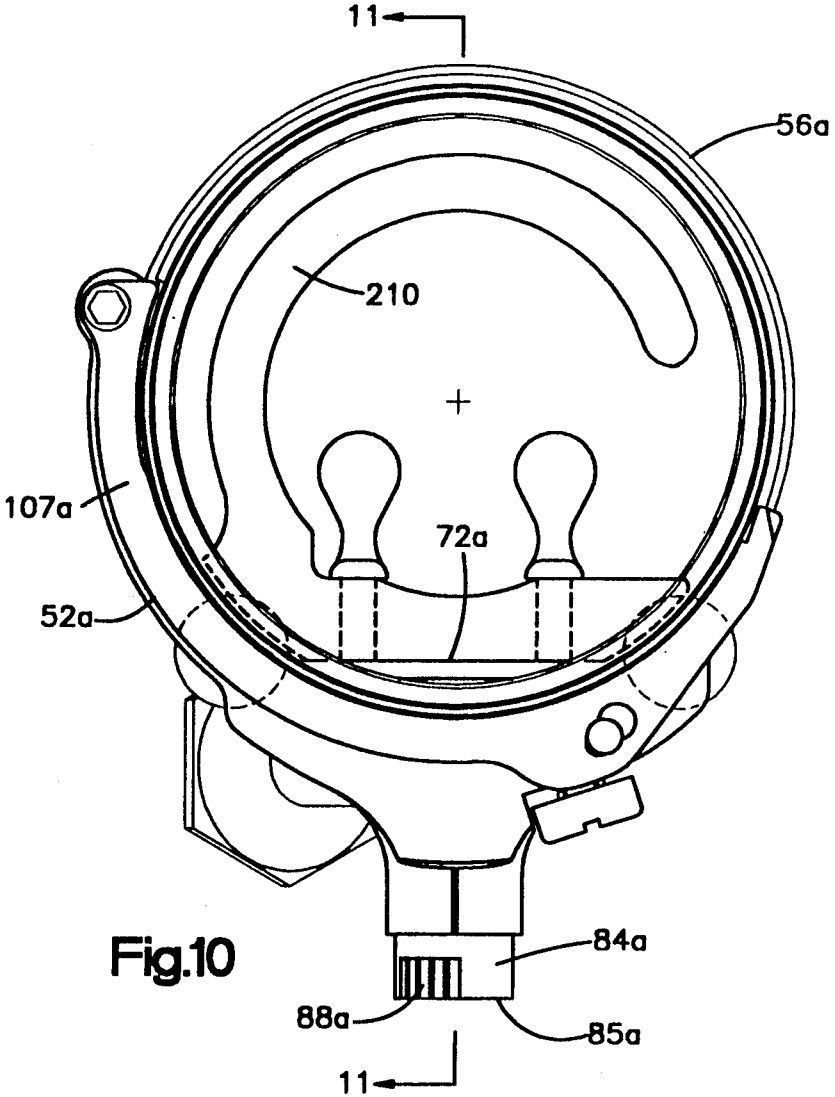
FIG. 10 is a top bottom view of a modular headpiece embodying the invention.
Figure 12:
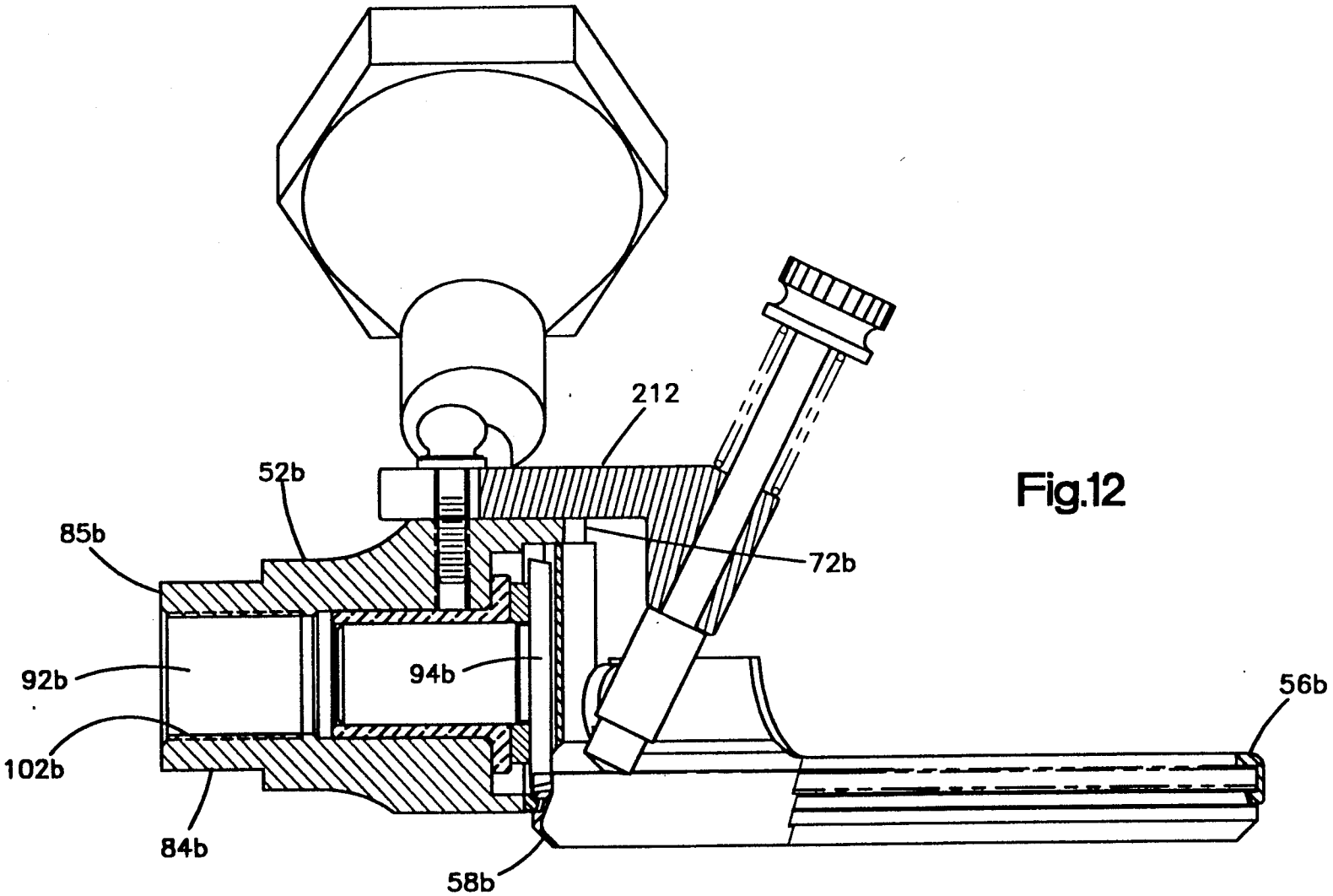
FIG. 12 is a longitudinal sectional view, with parts broken away, similar to that of FIG. 11, illustrating a further embodiment of a headpiece constructed in accordance with the present invention.

The transverse contour as viewed in end elevation from the front end 114 illustrating the shape of the first portion Gl is shown in FIG. 7, the cross sectional contour of the third portion G3 is shown in FIG. 8, and the cross sectional contour of the second section G2 is shown in FIG. 9.

The upper surface 190 is constructed to face and contact the palm of a gripping hand, the lower surface 192 is constructed to face and contact finger portions of a gripping hand, the medial side surface 194 is constructed to face and contact the distal ends of the fingers of a gripping hand, and the lateral side surface 196 is constructed to face and contact the palm adjacent the proximal ends of the fingers of a gripping hand. As shown in FIG. 8, the third portion G3 is greater in height than width and the height and width are each greatest in planes P1 and P2 that are substantially mutually perpendicular and that pass through the central longitudinal axis A of the handle.

With reference to FIG. 8, it can be seen that the upper surface 190 has a contour in cross section that is formed essentially of two circular arcs CA1 and CA2 of slightly different radius, each on an opposite side of the plane P1, the arc CA2 preferably having a radius about 12% greater than that of the arc CA1. The lower surface 192 has a contour in cross section that is formed essentially by a single circular arc of smaller radius than those of the arcs forming the upper surface, preferably about 70% of the length of the radius of the arc CA1, and bisected by the plane P1.

A part 194*a* and 196*a* of each side surface 194, 196 that extends between the horizontal plane P2 and the lower arcuate surface 192 has a substantially straight contour in cross section and the two parts converge toward each other in a direction toward the bottom surface. The medial side surface 194 between the plane P2 and the upper surface has a substantially straight contour in cross section adjacent the plane P2 and an arcuate contour adjacent the upper surface, which forms a smooth transition. The lateral side surface 196 between the plane P2 and the upper surface has a substantially arcuate contour in cross section, i.e., a more arcuate contour in cross section than the corresponding medial surface.

To improve the grip, the longitudinal portions G1, G2, G3 have circumferentially extending shallow and closely spaces grooves 198 that are shorter in length than the circumference of the handle, being in the form of four longitudinally extending areas peripherally spaced and extending along the surface portions where the height and width of the handle are greatest.

The above-described and illustrated handle shape affords a high degree of torque resistance when of proper size for the gripping hand and when properly gripped so that the appropriate handle surfaces contact the indicated portions of the gripping hand. As a result, gripping force can be reduced while still maintaining control of the knife. The grip is further enhanced by the use of a thin longitudinally ribbed rubber cover or sleeve 200 illustrated somewhat schematically on the handle shown in FIG. 2. The sleeve is the subject of a separate copending patent application Ser. No. 07/544,130, filed Jun. 25, 1990, now abandoned, the disclosure of which is hereby incorporated herein by reference.

Figure 36:
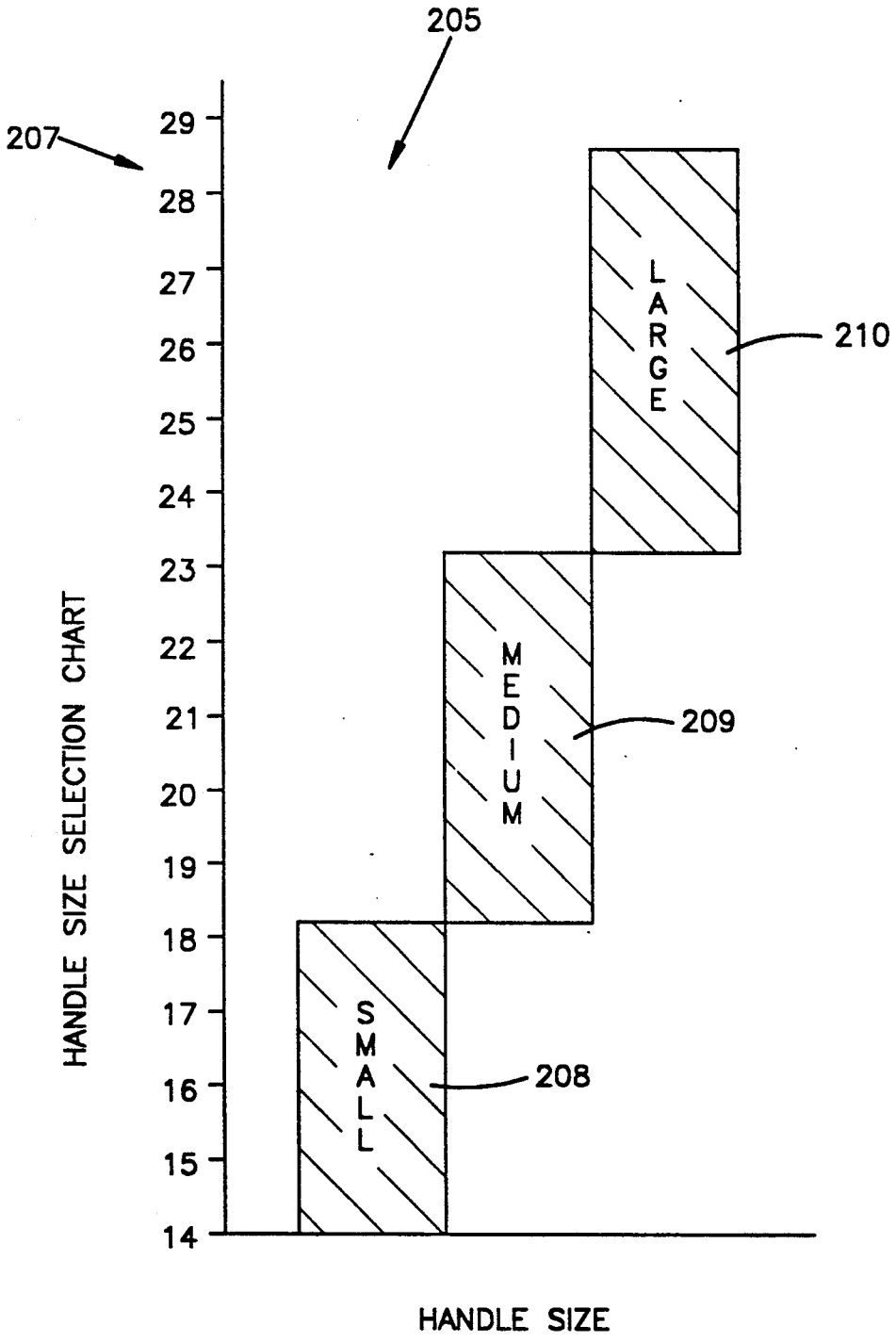

An appropriate selection of one of the three sizes of the handles 54 can be made based upon two measurements of the user's hand: the overall length of the hand and the palm breadth in the area of the knuckles. The mathematical product of those two measurements is then related to a chart, a preferred embodiment of which is shown at 205 in FIG. 36, to determine the handle size that will best fit the hand. The units of the product values 207, which range on the depicted chart from 14 to 29, are inches, and accordingly, the hand measurements must be taken in inches. Size designations 208, 209, 210 indicate the range of the product values 207 that correspond to each of the three sizes of available handles. Of course, more than three handle sizes could be provided for the same range of product values, in which case the range for each size would be smaller. The closest value 207 on the chart to the mathematical product of the hand measurements is then related to the adjacent handle size designation 208, 209 or 210. Of course, the indicia on the chart need not specify the sizes as expressly as set forth; for example, the product values can be color grouped and handles of a size appropriate to the grouped values can be of the same color. In addition, the product values can be indicated graphically rather than numerically and in either case the information can be displayed and the size determined other than with a chart; for example, on a slide rule, or with a computer in which a data base relates values 207 to size ranges.

Because different operations performed with power-driven rotary knives require blades of different shape and diameter, and in some cases it is also desired to provide depth-of-cut gauges or guides for the blades, or steeling devices to realign the cutting edge of the blade at frequent intervals during use, various headpieces an supported blade housings and blades are needed. The present modular construction facilitates the use of the same handles, thumb pieces, handle adapters, drive cable supports, pistol grips and cable casing connectors with separate headpieces for blade housings and blades of the various constructions needed. By way of example, in addition to the headpiece 52 shown and described in connection with the embodiment of FIGS. 1–3, the headpiece 52A of FIGS. 10 and 11, the headpiece 52B of FIG. 12 and the headpiece 52C of FIG. 13 illustrate the way in which the present modular system provides a complete range of knives for the various tasks that are performed with rotary knives of this general type having annular cutting blades.

The headpiece 52A supports a blade housing 56*a*, a blade retainer 107*a* and a depth control gauge 210 at a front end 72*a* of the headpiece. It has the cylindrical boss 84*a* previously referred to at a rear end 85*a* and a throughbore 92*a* of similar construction to the throughbore 92, supporting a drive pinion 94*a* for a blade 58*a* and having internal threads 102*a* for securing a handle 54 and thumb piece 60 or handle adapter 64, or the handle 186 or the drive cable support 68, in the manner described in connection with the knife 50. A unitary knife having substantially the same front end construction, blade housing, blade and the like as the headpiece 52A is shown in U.S. Pat. No. 4,516,323, the disclosure of which is incorporated herein by reference.

The headpiece 52B (FIG. 12) supports a blade housing 56*b* and a blade steeling assembly 212 at a front end 72*b* of the headpiece. It has a cylindrical boss 84*b* at a rear end 85*b* and a throughbore 92*b* of similar construction to the throughbore 92, supporting a drive pinion 94*b* for a blade 58*b* and having internal threads 102*b* for securing a handle 54 and thumb piece 60 or handle adapter 64, or the handle 186 or the drive cable support 68, in the manner described in connection with the knife 50. A unitary knife having substantially the same front end construction, blade housing, blade and the like as the headpiece 52B is shown in U.S. Pat. No. 4,854,046, the disclosure of which is incorporated herein by reference.

Figure 13:
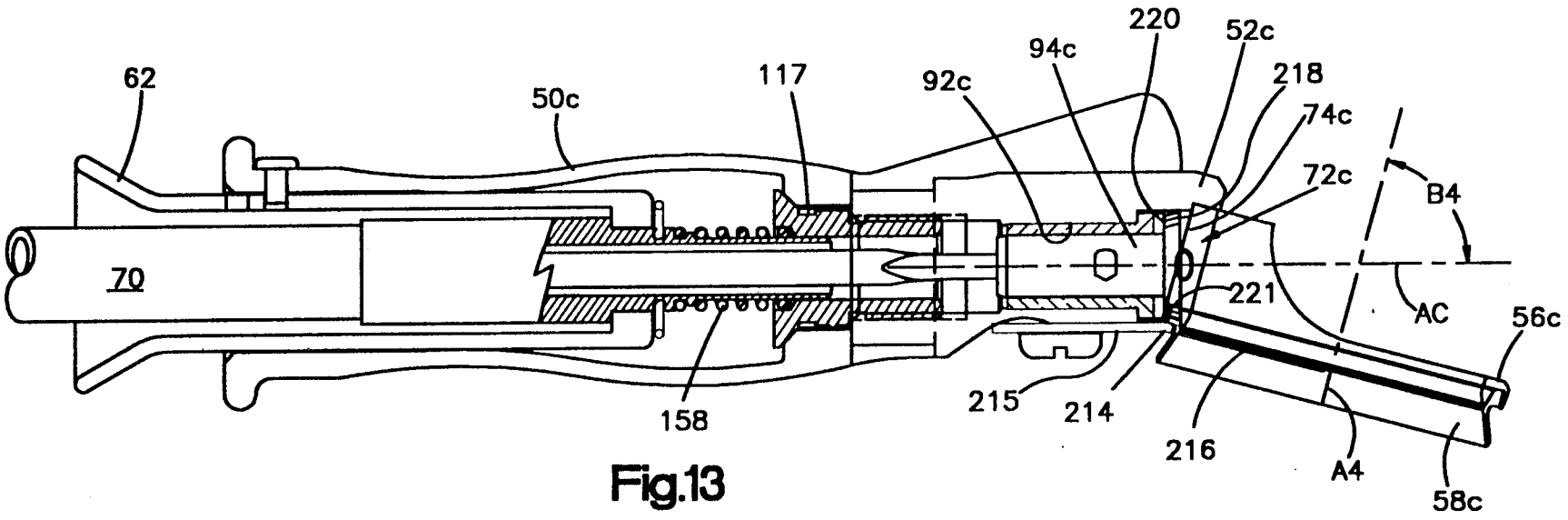
FIG. 13 is a longitudinal sectional view of a knife embodying the present invention, in which a blade housing and blade are tilted with respect to the axis of the knife handle.
Figure 15:
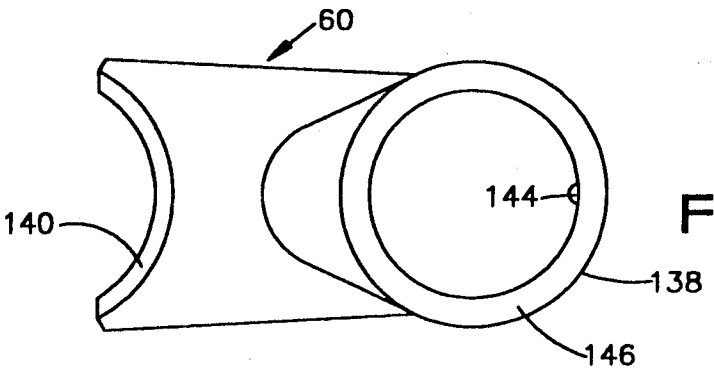
FIG. 15 is a top plan view of the thumb piece of FIG. 14.
Figure 14:
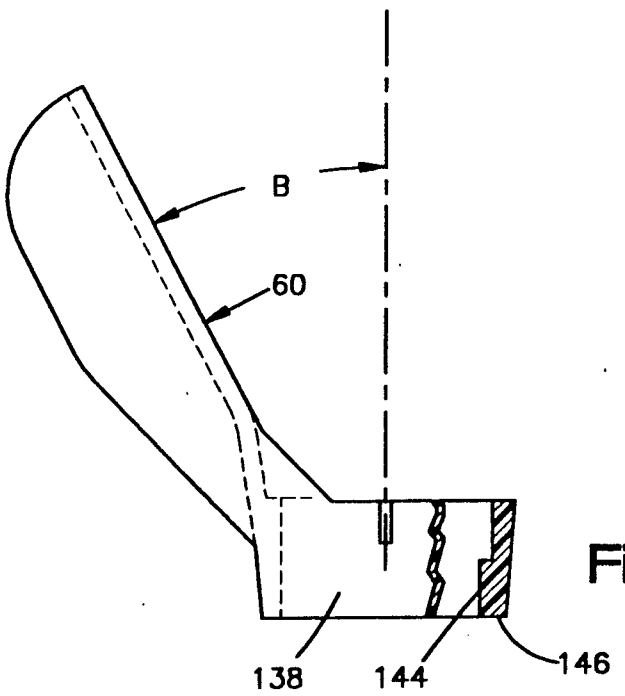
FIG. 14 is a side elevational view, partly in section, of a thumb piece embodying the present invention.
Figure 16:
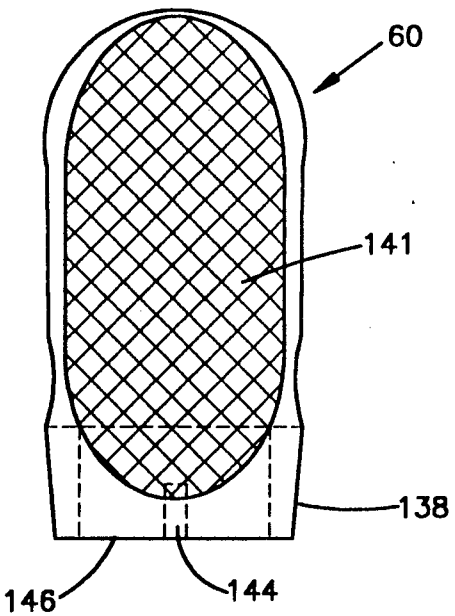
FIG. 16 is an elevational view of the thumb piece of FIG. 14 looking from the right.

A modular knife 50C is shown in FIG. 13 having a headpiece 52C that secures to a handle 54 in the same way as the headpiece 52 of FIGS. 1-3. The headpiece is similar to headpiece 52, but the front end 72*c* has a partial cylindrical face 74*c* that is analogous to the face 72 of the knife 50, but the central axis of curvature A4 of the cylindrical face is at an acute angle B4 with respect to the longitudinal central axis Ac of the handle 54 and the throughbore 92C, rather than perpendicular. In the preferred embodiment, the angle B4 is 75 degrees. The blade housing 56*c* is similar to the blade housing 56 but has a recess in the back, facing the cylindrical face 74*c*, that accommodates the pinion 94*c*, which is angularly related to the axis A4 of the housing 56*c*. The blade 58*c* is the same as the blade 58. The blade retaining yoke 107*c* has a bend 214 so that a securing portion 215 of the yoke can be attached to the headpiece in a plane parallel to the axis Ac and a blade contacting and retaining portion 216 can extend in a plane parallel to the plane of the annular housing and blade. A somewhat more preferable alternate construction uses a straight retaining yoke that is forked at the back and received in recessed or undercut headpiece areas on opposite sides of the headpiece, allowing the yoke to straddle the pinion and lie in a plan parallel with the blade housing. The pinion 94*c* has gear teeth 218 the roots and crests of which are inclined with respect to the central rotational axis of the pinion so that the teeth have a constant height, but the diameter of the gear increases from a rear surface 220 to a front surface 221. As a result, the teeth properly mesh with the inclined ring gear portion 82*c*, which is of a construction to also mesh with the pinion 94 when the housing and blade are secured in the orientation of FIGS. 1-3. For purposes of illustration, no grease cup as shown in FIGS. 1-3 as been shown, but is typically used.

The angular orientation of the blade provided by the headpiece 52C, relative to the handle axis, allows the plane of the blade to be substantially horizontal while the handle accommodates a more natural hand angle relative to the wrist and forearm, reducing the strain imposed by a blade in a horizontal plane parallel to the handle axis. Thus, for tasks where the blade 58*c* is typically used in a generally horizontal orientation or below, this arrangement is preferable. The same is true if the knife is held transversely of the operator's body to work on a product that is generally upright, because the angularly related handle allows the gripping hand to be at a more natural angle to the wrist and forearm.

While the invention has been described with particularity with respect to preferred constructions, it will be apparent that various modifications and alterations can be made therein without departing from the spirit and scope of the invention as set forth in the appended claims. In particular, it will be apparent that many of the constructional features and the advantages thereof are applicable to knives that are not modular in construction, but which may nevertheless incorporate one or more of such features. It will also be apparent that the improved handle construction, while specifically advantageous for power-driven rotary knives, will also find useful application for tools or implements others than power-driven rotary knives and need not be angularly adjustable relative to a blade or other implement to achieve advantages inherent in the handle shape. In particular, the improved handle construction will find usefulness for fixed blade knives as used in the meat processing industry and other industries.

We claim:

1. A set of standardized components combinable to provide a modular power-driven knife having an annular rotary blade, the structure of which knife can be varied through choice of components to accommodate different operators and different tasks, said components comprising plural elongated handles to accommodate different sized hands, plural headpieces each having a transmission for driving an annular rotary blade and identical means by which any of the handles are attachable in a first orientation and each headpiece differently constructed to support a replaceable blade housing of predetermined size and construction different from housings supported by other headpieces of the set, and replaceable blade housings securable to the headpieces for supporting replaceable rotary annular blades.

2. A set of components as set forth in claim 1 including a thumb piece and a handle adapter each having similar means for attachment to headpieces of the set and wherein said headpieces have means for supporting the thumb piece or in place thereof the handle adapter, and the handle adapter has means for securing any one of the plural handles of the set in a second orientation transversely of the first orientation.

3. A set of components as set forth in claim 2 including a drive cable support, attachable to the plural headpieces in place of the handles attached in the first orientation by the identical means by which the handles can be attached, for use with the headpieces when a handle adapter is used.

4. A set of components as set forth in claim 3 including a drive cable casing connector receivable in any of said handles or in said drive cable support for securing a flexible drive cable in either a handle or a drive cable support attached to one of the plural headpieces.

5. A set of components as set forth in claim 2 wherein the handle adapter includes an arm extending laterally and upwardly from the headpiece when attached thereto, laterally with respect to a vertical plane through the center of the annular blade and upwardly with respect to a horizontal plane, said arm having means at a distal end for supporting a handle by which the knife can be gripped for use, said handle securable to said means at the distal end of the arm to extend transversely with respect to said vertical plane, and including means extending from the headpiece for securing a drive means to the knife for rotating the annular blade.

6. A set of components as set forth in claim 1 wherein said handles are non-circular in cross section and said identical means for connecting said handles to the headpieces includes means for adjusting the handles about a longitudinal axis thereof relative to a headpiece to which a handle is attached.

7. A set of components as set forth in claim 1 wherein each of said headpieces comprises a body having a front end for supporting the blade housings, a rear end for removably securing the blade handles, a through passage opening through the front and rear ends in which said transmission is located, said rear opening being adapted to receive means for driving said transmission, and means for securing any one of the handles at one end to the headpiece for rotational adjustment relative thereto in predetermined fixed increments about a central longitudinal axis of the passage.

8. A set of components as set forth in claim 7 wherein said each of said handles has a central passage, and the handles or the rear openings of the headpieces have a splined portion, and wherein said securing means is a tubular member having a threaded portion for attachment to either a handle or a headpiece, a splined portion receivable in the splined portion of the other of the handle or headpiece, and a head portion receivable in the handle or headpiece that has the splined portion for retaining the one in which it is received on the tubular member when the tubular member is attached to the other of the handle or headpiece, said threaded portion being longer axially than the splined portions.

9. A set of components as set forth in claim 7 wherein each of said handles has a central passage with a splined portion adjacent one end of the passage, and wherein said securing means is a tubular member having a threaded portion for attachment to the handpiece a splined portion receivable in the splined portion of the handle, and a head portion receivable in the handle for retaining the handle on the tubular member when the member is attached to the handpiece, said threaded portion being longer axially than the splined portions.

10. A set of components as set forth in claim 7 wherein said handles are tubular with openings at a front end attachable to said headpieces and at a rear end remote therefrom, and a cable casing member receivable in said handles for limited axial and rotational movement relative to a handle in which it is received, said cable casing connector being tubular and including means to receive a flexible drive shaft in fixed axial relationship and extending through front and rear ends of the cable casing connector, and a guide slot in an external surface of the connector, opening through the front end thereof, extending axially along the connector from the opening for less than the entire length of the connector then extending peripherally and then extending axially toward the front end and terminating short of the front end, and a radially extending projection within each of the handles, receivable in said slot, and means within said handles for biasing the cable casing connector in a direction toward the rear end of the handles.

11. A set of components as set forth in claim 7 wherein said handles are generally elongated and adapted to be gripped in one hand, and have longitudinal portions including a first portion adjacent one end and adapted to be connected to the blade housings, a second portion adjacent an opposite end of the handle, and a third portion between the first and second portions, all three portions adapted to be gripped, the first and second portions each being substantially circular in cross sectional contour and of smaller cross sectional area than the third portion, and arcuate longitudinal surface transitions between adjacent first and third, and second and third, portions, said third portion having an upper surface constructed to face and contact the palm of a gripping hand, a lower surface constructed to face and contact finger portions of a gripping hand, a side surface constructed to face and contact the palm adjacent the proximal ends of the fingers of a gripping hand, and a medial side surface constructed to face and contact the distal ends of the fingers of a gripping hand, said third portion having a cross sectional shape that has an arcuate upper surface, an arcuate lower surface of smaller radius than the upper surface, and flat downwardly converging sides in part forming a lower half, and the longitudinal contour of said third portion being straight along a horizontal midplane and convexly curved along a vertical midplane.

12. A set of components as set forth in claim 7 wherein said front end includes a cylindrically arcuate concave surface having a central axis of curvature in a plane common to a central axis of the through passage and forming an acute angle with said central axis of the through passage.

13. A set of components as set forth in claim 1 wherein each of said headpieces comprises a body having a front end for supporting a blade housing, a rear end for removably securing a handle, a through passage opening through the front and the rear, said transmission being located in said passage, said rear opening being adapted to receive means for driving said transmission, and a member securable to the rear end and having means for attaching a handle to the handpiece in fixed relation while permitting rotational adjustment of the handle about a central axis of the through passage.

14. A set of components as set forth in claim 13 wherein said front end includes a cylindrically arcuate concave surface having a central axis of curvature in a plane common to said central axis of the through passage and forming an acute angle therewith.

15. A set of components as set forth in claim 1 wherein each of said handles has a longitudinal central axis and an annular blade housing a face of which defines a plane, said housings securable to said handles and each having a central axis perpendicular to said plane and located in a plane common to the longitudinal central axis of a handle when the handle and housing are secured to a headpiece, the plane of such a secured housing being oriented relative to the longitudinal central axis so as to intersect said longitudinal central axis, and the central axis of the housing intersecting the longitudinal central axis at an acute angle.

16. A set of compounds as set forth in claim 15 wherein said acute angle is approximately 75 degrees.

17. A set of components as set forth in claim 1 wherein at least one of said headpieces comprises a body having a front end for supporting a blade housing and a rear end for removably securing an elongated handle along a central longitudinal axis, said front end including a cylindrically arcuate concave surface having a central axis of curvature in a plane common to said central axis and forming an acute angle with the central axis.

18. A set of components as set forth in claim 1 wherein at least one of said handles is generally elongated and adapted to be gripped in one hand, and has longitudinal portions including a first portion adjacent one end and adapted to be connected to the headpiece, a second portion adjacent an opposite end of the handle, and a third portion between the first and second portions, all three portions adapted to be gripped, the first and second portions each being substantially circular in cross sectional contour and of smaller cross sectional area than the third portion, and arcuate longitudinal surface transitions between adjacent first and third, and second and third, portions, said third portion having an upper surface constructed to face and contact the palm of a gripping hand, a lower surface constructed to face and contact finger portions of a gripping hand, a side surface constructed to face and contact the palm adjacent the proximal ends of the fingers of a gripping hand, and a medial side surface constructed to face and contact the distal ends of the fingers of a gripping hand, said third portion having a cross sectional shape that has an arcuate upper surface, an arcuate lower surface of smaller radius than the upper surface, and flat downwardly converging sides in part forming a lower half, and the longitudinal contour of said third portion being straight along a horizontal midplane and convexly curved along a vertical midplane.

19. A set of components as set forth in claim 1 including a cable casing connector for connecting a rotary flexible cable and a surrounding flexible casing that is receivable within the handles, said cable casing connector constructed to be received in said handles for limited axial and rotational movement relative to the handles, said cable casing connector being tubular and including means to receive a rotary flexible cable in fixed axial relationship and extending through front and rear ends of the connector, and a guide slot in an external surface of the cable casing connector, opening through the front end thereof, extending axially along the connector from the opening for less than the entire length of the connector, then extending peripherally and then extending axially toward the front end and terminating short of the front end, said guide slot being adapted to receive a radially extending projection within the handles.

20. A set of components as set forth in claim 1 including a thumb piece securable to said headpieces, said thumb piece having an elongated concave thumb-engaging blade oriented to extend from a headpiece.

21. A set of components as set forth in claim 20 wherein said thumb piece includes means for securing the thumb piece to said headpieces, said means including a ring constructed to encircle a portion of a headpiece and wherein said ring includes means to prevent rotation relative to a headpiece.

22. A set of components as set forth in claim 21 wherein the acute angle is between 25 and 30 degrees.

23. A set of components as set forth in claim 21 wherein said securing means permits rotation of the ring relative to said support when the ring does not encircle said portion of said support.

24. A set of components as set forth in claim 1 including a thumb piece, each of said headpieces comprising a body having a front end for supporting a blade housing and a rear end for attachment to an elongated handle along a central longitudinal axis, said body having a cylindrical boss at the rear end and recesses spaced peripherally about a portion of the boss, said thumb piece having securing means encircling said boss and means selectively engageable with said recesses for preventing relative rotation of said thumb piece and headpiece.

25. A set of components as set forth in claim 24 including means for attaching one of the handles to one of the headpieces to allow limited longitudinal movement between the two, and wherein said recesses are axially extending grooves opening through the boss at the rear end, and said means engageable with the recesses is a key on the encircling securing means receivable in a selected one of said grooves, said key being shorter in length than the extent of said limited longitudinal movement, whereby the handle can be moved longitudinally relative to the headpiece to allow the encircling securing means to move longitudinally to remove the key from a groove and be rotated relative to the handpiece and moved axially to place the key in a different groove and thereby change the position of the thumb piece.

26. A set of components as set forth in claim 1 including a handle adapter having means for attachment to a headpiece, an arm extending from said means, and means at a distal end of the arm to attach an elongated handle.

27. A set of components as set forth in claim 26 wherein said means at the distal end of the arm includes means to adjust the handle relative to the arm about a longitudinal axis of the handle.

28. A set of components as set forth in claim 26 wherein said attachment means includes a ring constructed to encircle first and second axially displaced peripheral portions of said headpiece and wherein said ring and first peripheral portion include means to prevent rotation relative to said headpiece when the ring encircles said first portion of the headpiece.

29. A set of components as set forth in claim 28 wherein said attachment means and said peripheral portions permit movement between positions where the ring encircles both said portions and rotation of the ring relative to said headpiece is prevented, and where the ring encircles only the second portion and rotation of the ring is permitted.

30. A set of components as set forth in claim 26 wherein said headpiece comprises a body having a front end for supporting a blade housing, a rear end for attachment to an elongated handle, an elongated throughbore opening through said front and rear ends, said handle constructed for attachment to a handle adapter to orient a handle transversely of said throughbore, said body having a cylindrical boss at the rear end and recesses spaced peripherally about a portion of the boss, and said handle adapter having an arm, securing means at one end of said arm for encircling said boss and means selectively engageable with said recesses for preventing relative rotation of said handle adapter and headpiece, and means at the other end of the arm for securing said elongated handle offset from said throughbore.

31. A set of components as set forth in claim 30 including means for attaching the handle adapter to a headpiece to allow limited longitudinal movement between the two, and wherein said recesses are axially extending grooves opening through the boss at the rear end, and said means engageable with the recesses is a key on the encircling securing means receivable in a selected one of said grooves, said key being shorter in length than the extent of said limited longitudinal movement, whereby the handle adapter can be moved longitudinally relative to a headpiece to allow the encircling securing means to move longitudinally to remove the key from a groove and be rotated relative to the headpiece and moved axially to place the key in a different groove and thereby change the position of the handle adapter.

32. A set of components as set forth in claim 1 wherein at least one of said handles is generally elongated and adapted to be gripped in one hand, and has longitudinal portions including a first portion adjacent one end and adapted to be connected to a headpiece, a second portion adjacent an opposite end of the handle, and a third portion between the first and second portions, all three portions adapted to be gripped, the first and second portions each being substantially circular in cross sectional contour and of smaller cross sectional area than the third portion, and arcuate longitudinal surface transitions between adjacent first and third, and second and third, portions, said third portion having an upper surface constructed to face and contact the palm of a gripping hand, a lower surface constructed to face and contact finger portions of a gripping hand, a lateral side surface constructed to face and contact the palm adjacent the proximal ends of the fingers of a gripping hand, and a medial side surface constructed to face and contact the distal ends of the fingers of a gripping hand, said third portion being higher than it is wide and the height and width each being greatest in planes that are substantially mutually perpendicular and that pass through a central longitudinal axis of the handle, the upper surface having a contour in cross section formed essentially of two circular arcs of different radius each on an opposite side of one of said planes, the lower surface having a portion that has a contour in cross section formed essentially by a single circular arc of smaller radius than those of the arcs forming the upper surface, a part of each side surface extending between a longitudinal plane at the location of greatest width and the lower surface having a portion that has a substantially straight contour in cross section and each part converging in a direction toward the lower surface, the lateral side surface between the plane of greatest width and the upper surface having a substantially arcuate contour in cross section, and the medial side surface between the plane of greatest width and the upper surface having a substantially straight contour in cross section adjacent the plane of greatest width and an arcuate contour adjacent the upper surface.

33. A set of components as set forth in claim 32 wherein said first, second and third longitudinal portions have circumferentially extending grooves that are shorter in length than the circumference of the handle.

34. A set of components as set forth in claim 32 including a central longitudinal passage extending along a central axis of the length of the handle and opening through both of said ends of the handle.

35. A set of components as set forth in claim 32 wherein said side surfaces of the third portion are longitudinally straight over substantially the full longitudinal length of the third portion at and adjacent to the part of each side surface at the location of greatest width.

36. A set of standardized components as set forth in claim 1, wherein at least one of said handles has a tubular portion attachable to said headpieces and a hand grip portion extending transversely from and in a plane common to the tubular portion and inclined toward a headpiece when the handle is attached, and means in the tubular portion for supporting means to drive a transmission of said headpieces.

37. A set of components as set forth in claim 1 including an elongated handle having a tubular portion attachable to extend generally horizontally from said headpiece rearwardly from the cutting blade and a hand grip portion extending upwardly from and in a plane common to the tubular portion and inclined forwardly relative to the tubular portion toward the annular cutting blade, and means in the tubular portion for supporting motive means to rotate the blade.

38. A set of components as set forth in claim 37 wherein said handle is a separate component from said headpiece and said set includes means to connect the headpiece for relative rotational adjustment about a central axis of said tubular portion.

39. A power driven rotary knife comprising an elongated handle portion, a headpiece portion attached to the handle portion, a ring blade housing attached to the headpiece portion, a ring blade carried for relative rotation by said blade housing, said ring blade having a cutting edge at one axial end and a ring gear portion at an opposite axial end, a pinion gear in said headpiece portion for engaging said ring gear portion and rotating said blade, said handle portion having a central longitudinal first axis in a horizontal plane, said housing and blade having ring centers on a second axis of the handle, and said second axis being inclined with respect to a vertical so that a plane defined by the ring blade housing and blade is inclined downwardly from the horizontal plane.

40. A power-driven rotary knife comprising a handle, a blade housing secured to one end of the handle and an annular blade supported for rotation by the housing, said handle being generally elongated and adapted to be gripped in one hand, and having longitudinal portions including a first portion adjacent one end and adapted to be connected to the blade housing, a second portion adjacent an opposite end of the handle, and a third portion between the first and second portions, all three portions adapted to be gripped, the first and second portions each being substantially circular in cross sectional contour and of smaller cross sectional area than the third portion, and arcuate longitudinal surface transitions between adjacent first and third, and second and third, portions, said third portion having an upper surface constructed to face and contact the palm of a gripping hand, a lower surface constructed to face and contact finger portions of a gripping hand, a side surface constructed to face and contact the palm adjacent the proximal ends of the fingers of a gripping hand, and a medial side surface constructed to face and contact the distal ends of the fingers of a gripping hand, said third portion having a cross sectional shape that has an arcuate upper surface, an arcuate lower surface of smaller radius than the upper surface, and flat downwardly converging sides in part forming a lower half, and the longitudinal contour of said third portion being straight along a horizontal midplane and convexly curved along a vertical midplane.

41. A power-driven knife comprising a handle, a blade housing secured to one end of the handle and an annular blade supported for rotation by the housing, said handle being generally elongated and adapted to be gripped in one hand, and having longitudinal portions including a first portion adjacent one end and adapted to be connected to the blade housing a second portion adjacent an opposite end of the handle, and a third portion between the first and second portions, all three portions adapted to be gripped, the first and second portions each being substantially circular in cross sectional contour and of smaller cross sectional area than the third portion, and arcuate longitudinal surface transitions between adjacent first and third, and second and third, portions, said third portion having an upper surface constructed to face and contact the palm of a gripping hand, a lower surface constructed to face and contact finger portions of a gripping hand, a lateral side surface constructed to face and contact the palm adjacent the proximal ends of the fingers of a gripping hand, and a medial side surface constructed to face and contact the distal ends of the fingers of a gripping hand, said third portion being higher than it is wide and the height and width each being greatest in planes that are substantially mutually perpendicular and that pass through a central longitudinal axis of the handle, the upper surface having a portion that has a contour in cross section formed essentially of two circular arcs of different radius each on an opposite side of one of said planes, the lower surface having a contour in cross section formed essentially by a single circular arc of smaller radius than those of the arcs forming the upper surface, a part of each side surface extending between a longitudinal plane at the location of greatest width and the lower surface having a portion that has a substantially straight contour in cross section and each part converging in a direction toward the lower surface, the lateral side surface between the plane of greatest width and the upper surface having a substantially arcuate contour in cross section, and the medial side surface between the plane of greatest width and the upper surface having a substantially straight contour in cross section adjacent the plane of greatest width and an arcuate contour adjacent the upper surface.

42. A power driven rotary knife as set forth in claim 41 wherein said first, second and third longitudinal portions have circumferentially extending grooves that are shorter in length than the circumference of the handle.

43. A power driven rotary knife as set forth in claim 41 including a central longitudinal passage extending along the central longitudinal axis the length of and opening through both of said ends of the handle.

44. A power driven rotary knife as set forth in claim 41 wherein said side portions of the third portion are longitudinally straight over substantially the full longitudinal length of the third portion at and adjacent to the part of each side surface at the location of greatest width.

45. A power driven rotary knife comprising a headpiece that supports a rotary annular cutting blade in a horizontal plane, an arm extending laterally and upwardly from the headpiece, laterally with respect to a vertical plane through the center of the annular blade and upwardly with respect to the horizontal plane, said arm having means at a distal end for supporting a handle by which the knife can be gripped for use, a handle secured to said means at the distal end of the arm and extending transversely with respect to said vertical plane, and means extending from the headpiece for securing a drive means to the knife for rotating the annular blade.

46. A power driven rotary knife comprising a headpiece that supports a rotary annular cutting blade in a horizontal plane, an elongated handle having a tubular portion extending generally horizontally from said headpiece rearwardly from the cutting blade and a hand grip portion extending upwardly from and in a plane common to the tubular portion and inclined forwardly relative to the tubular portion toward the annular cutting blade, and means in the tubular portion for supporting means to rotate the blade.

47. A power driven rotary knife as set forth in claim 46 wherein said handle is a separate component from said headpiece and is connected to the headpiece for relative rotational adjustment about a central axis of said tubular portion.

48. In combination, a rotary knife having a tubular handle with an open end, an annular cutting blade, a transmission for driving the cutting blade, said transmission having means connectable to a rotary flexible cable with a flexible casing when extended within the handle, and a cable casing connector supported in said handle for axial and rotational movement relative to the handle, said cable casing connector being tubular and including means to receive a flexible casing in fixed axial relationship extending through front and rear ends of the connector, and a guide slot in an external surface of the cable casing connector, opening through the front end thereof, extending axially along the connector from the opening for less than the entire length of the connector then extending peripherally and then extending axially toward the front end and terminating short of the front end, and said handle having a fixed and inwardly extending projection received in said guide slot to retain said cable casing connector within said handle.

49. A knife having a power-driven annular rotary blade and including a blade housing, a headpiece and a handle, said handle having a non-circular external contour in cross section, and said headpiece comprising a body having a front end supporting the blade housing, a rear end removably securing the handle, a through passage opening through the front and rear ends, and a transmission in said passage for driving said blade, said rear opening being adapted to receive means for driving said transmission, and means securing the handle at one end to the headpiece for rotational adjustment relative thereto in predetermined fixed increments about a central longitudinal axis of the passage.

50. A knife as set forth in claim 49 wherein said handle has a central passage, one of said handle and rear opening having a splined portion adjacent to the other, and wherein said securing means is a tubular member having a threaded portion for attachment to one of the handle and headpiece, a splined portion receivable in the splined portion of the other, and a head portion receivable in the one of the handle and headpiece that has the splined portion for retaining the one in which it is received on the tubular member when the tubular member is attached to the other, said threaded portion being longer axially than the splined portions.

51. A knife as set forth in claim 49 wherein said handle has a central passage and a splined portion adjacent to the headpiece, and wherein said securing means is a tubular member having a threaded portion for attachment to the headpiece, a splined portion receivable in the splined portion of the handle, and a head portion receivable in the handle for retaining the handle on the tubular member when the member is attached to the handpiece, said threaded portion being longer axially than the splined portions.

52. A knife as set forth in claim 49 wherein said handle is tubular with openings at a front end adjacent said headpiece and at a rear end remote therefrom, and including a cable casing connector received in said handle for limited axial and rotational movement relative to the handle, said cable casing connector being tubular and including means to receive a flexible drive shaft in fixed axial relationship and extending through front and rear ends, and a guide slot in an external surface of the cable casing connector, opening through the front end thereof, extending axially along the connector from the opening for less than the entire length of the connector then extending peripherally and then extending axially toward the front end and terminating short of the front end, and a radially extending projection within the handle, receivable in said slot, and means within said handle for biasing the cable casing connector in a direction toward the rear end of the handle.

53. A knife as set forth in claim 49, wherein said handle is generally elongated and adapted to be gripped in one hand, and having longitudinal portions including a first portion adjacent one end and adapted to be connected to said blade housing, a second portion adjacent an opposite end of the handle, and a third portion being the first and second portions, all three portions adapted to be gripped, the first and second portions each being substantially circular in cross sectional contour and of smaller cross sectional area than the third portion, and arcuate longitudinal surface transitions between adjacent first and third, and second and third, portions, said third portion having an upper surface constructed to face and contact the palm of a gripping hand, a lower surface constructed to face and contact finger portions of a gripping hand, a side surface constructed to face and contact the palm adjacent the proximal ends of the fingers of a gripping hand, and a medial side surface constructed to face and contact the distal ends of the fingers of a gripping hand, said third portion having a cross sectional shape that has an arcuate upper surface, an arcuate lower surface of smaller radius than the upper surface, and flat downwardly converging sides in part forming a lower half, and the longitudinal contour of said third portion being straight along a horizontal midplane and convexly curved along a vertical midplane.

54. A knife as set forth in claim 49 wherein said front end includes a cylindrical arcuate concave surface having a central axis of curvature in a plane common to a central axis of the through passage and forming an obtuse angle with said central axis.

55. A headpiece for a knife having a power-driven annular rotary blade, said headpiece comprising a body having a front end for supporting a blade housing, a rear end for removably securing a handle, a through passage opening through the front and the rear, and a transmission in said passage for driving said blade, said rear opening being adapted to receive means for driving said transmission, and a member secured to the rear end and having means for attaching the handle to the headpiece in fixed relation while permitting rotational adjustment of the handle about a central axis of the through passage.

56. A headpiece as set forth in claim 55 wherein said front end includes a cylindrically arcuate concave surface having a central axis of curvature in a plane common to said central axis and forming an obtuse angle therewith.

57. A knife having a power-driven annular rotary blade and including an elongated handle having a longitudinal central axis and an annular blade housing a face of which defines a plane, said housing secured to said handle and having a central axis perpendicular to said plane and located in a plane common to the longitudinal central axis, the plane of said housing being oriented relative to the longitudinal central axis so as to intersect the axis, and the central axis of the housing intersecting the longitudinal axis at an acute angle.

58. A knife as set forth in claim 57 wherein said acute angle is approximately 75 degrees.

59. A headpiece for a knife having a power-driven annular rotary blade, said headpiece comprising a body having a front end for supporting a blade housing and a rear end for removably securing an elongated handle along a central longitudinal axis, said front end including a cylindrically arcuate concave surface having a central axis of curvature in s plane common to said central axis and forming an acute angle with the central axis.

60. In combination, a thumb piece and a knife having a power-driven annular rotary cutting blade carried by a housing that extends from a support that includes an elongated handle, said thumb piece including means for securing said thumb piece at one end thereof to the support, and an elongated concave thumb-engaging blade extending from said securing means and cantilevered from the means and extending therefrom at an acute angles to the direction of elongation of the handle entirely spaced from the support, when the thumb piece is secured to the support.

61. The combination as set forth in claim 60 wherein the cutting blade has a central axis of rotation that lies in a common plane with a central longitudinal axis of the handle, and the thumbpiece is offset to one side of the common plane.

62. The combination as set forth in claim 60 wherein said securing means includes a ring constructed to encircle a portion of said support and wherein said ring includes means to prevent rotation relative to said portion of said support when the ring encircles said portion of the support.

63. The combination as set forth in claim 62 wherein the acute angle is between 25 and 30 degrees.

64. The combination as set forth in claim 62 wherein said securing means permits rotation of the ring relative to said support when the ring does not encircle said portion of said support.

65. In combination, a headpiece, an elongated handle, and a thumb piece for a knife having a power-driven annular rotary blade, said headpiece comprising a body having a front end for supporting a blade housing and a rear end for attachment to said elongated handle along a central longitudinal axis, said body having a cylindrical boss at the rear end and recesses spaced peripherally about a portion of the boss, said thumb piece having securing means encircling said boss and means selectively engageable with said recesses for preventing relative rotation of said thumb piece and headpiece.

66. The combination as set forth in claim 65 including means for attaching the handle to the headpiece to allow limited longitudinal movement between the two, and wherein said recesses are axially extending grooves opening through the boss at the rear end, and said means engageable with the recesses is a key on the encircling securing means receivable in a selected one of said grooves, said key being shorter in length than the extent of said limited longitudinal movement, whereby the handle can be moved longitudinally relative to the headpiece to allow the encircling securing means to move longitudinally to remove the key from a groove and be rotated relative to the handpiece and moved axially to place the key in a different groove and thereby change the position of the thumb piece.

67. A handle adaptor for a rotary knife having a power-driven annular blade, said adapter having means for attachment to a headpiece that supports the blade, an arm extending from said means, and means at a distal end of the arm to attach an elongated handle, wherein said headpiece has first and second portions and said attachment means includes a ring constructed to encircle first and second portions of said headpiece and wherein said ring includes means to prevent rotation relative to said headpiece when the ring encircles said first portion of the headpiece.

68. A handle adapter as set forth in claim 67 wherein said attachment means and said first and second portions permit movement between positions where the ring encircles both said portions and rotation of the ring relative to said headpiece is prevented, and where the ring encircles only the second portion and rotation of the ring is permitted.

69. In combination, a headpiece, an elongated handle, and a handle adapter for a knife having a power-driven annular rotary blade, said headpiece comprising a body having a front end for supporting a blade housing, a rear end for attachment to an elongated handle or drive cable support, an elongated throughbore opening through said front and rear ends, said handle constructed for attachment to a handle adapter to orient a handle transversely of said throughbore, said body having a cylindrical boss at the rear end and recesses spaced peripherally about a portion of the boss, and said handle adapter having an arm, securing means at one end of said arm encircling said boss and means selectively engageable with said recesses for preventing relative rotation of said handle adapter and headpiece, and means at the other end of the arm for securing said elongated handle offset from said throughbore.

70. The combination as set forth in claim 69 including means for attaching the handle adapter to the headpiece to allow limited longitudinal movement between the two, and wherein said recesses are axially extending grooves opening through the boss at the rear end, and said means engageable with the recesses is a key on the encircling securing means receivable in a selected one of said grooves, said key being shorter in length than the extent of said limited longitudinal movement, whereby the handle adapter can be moved longitudinally relative to the headpiece to allow the encircling securing means to move longitudinally to remove the key from a groove and be rotated relative to the headpiece and moved axially to place the key in a different groove and thereby change the position of the handle adapter.

71. A handle for a working element, said handle being generally elongated and adapted to be gripped in one hand, and having longitudinal portions including a first portion adjacent one end and adapted to be connected to the working element, a second portion adjacent an opposite end of the handle, and a third portion between the first and second portions, all three portions adapted to be gripped, the first and second portions each being substantially circular in cross sectional contour and of smaller cross sectional area than the third portion, and arcuate longitudinal surface transitions between adjacent first and third, and second and third, portions, said third portion having an upper surface constructed to face and contact the palm of a gripping hand, a lower surface constructed to face and contact finger portions of a gripping hand, a side surface constructed to face and contact the palm adjacent the proximal ends of the fingers of a gripping hand, and a medial side surface constructed to face and contact the distal ends of the fingers of a gripping hand, said third portion having a cross sectional shape that has an arcuate upper surface, an arcuate lower surface of smaller radius than the upper surface, and flat downwardly converging sides in part forming a lower half, and the longitudinal contour of said third portion being straight along a horizontal midplane and convexly curved along a vertical midplane.

72. A handle for a working element, said handle being generally elongated and adapted to be gripped in one hand, and having longitudinal portions including a first portion adjacent one end and adapted to be connected to a working element, a second portion adjacent an opposite end of the handle, and a third portion between the first and second portions, all three portions adapted to be gripped, the first and second portions each being substantially circular in cross sectional contour and of smaller cross sectional area than the third portion, and arcuate longitudinal surface transitions between adjacent first and third, and second and third, portions, said third portion having an upper surface constructed to face and contact the palm of a gripping hand, a lower surface constructed to face and contact finger portions of a gripping hand, a lateral side surface constructed to face and contact the palm adjacent the proximal ends of the fingers of a gripping hand, and a medial side surface constructed to face and contact the distal ends of the fingers of a gripping hand, said third portion being higher than it is wide and the height and width each being greatest in planes that are substantially mutually perpendicular and that pass through a central longitudinal axis of the handle, the upper surface having a contour in cross section formed essentially of two circular arcs of different radius each on an opposite side of one of said planes, the lower surface having a portion that has a contour in cross section formed essentially by a single circular arc of smaller radius than those of the arcs forming the upper surface, a part of each side surface extending between a longitudinal plane at the location of greatest width and the lower surface having a portion that has a substantially straight contour in cross section and each part converging in a direction toward the lower surface, the lateral side surface between the plane of greatest width and the upper surface having a substantially arcuate contour in cross section, and the medial side surface between the plane of greatest width and the upper surface having a substantially straight contour in cross section adjacent the plane of greatest width and an arcuate contour adjacent the upper surface.

73. A handle as set forth in claim 72 wherein said first, second and third longitudinal portions have circumferentially extending grooves that are shorter in length than the circumference of the handle.

74. A handle as set forth in claim 72 including a central longitudinal passage extending along the central longitudinal axis the length of and opening through both of said ends of the handle.

75. A handle as set forth in claim 74 wherein said working element is a rotary annular knife blade, and said handle includes a drive transmission in said longitudinal passage for rotating said blade.

76. A handle as set forth in claim 72 wherein said side surfaces of the third portion are longitudinally straight over substantially the full longitudinal length of the third portion at and adjacent to the part of each side surface at the location of greatest width.

77. A cable casing connector for a rotary knife having a tubular handle with an open end and an annular cutting blade driven by a rotary flexible cable within a flexible casing that extends within the handle, said cable casing connector constructed to be received in said handle for limited axial and rotational movement relative to the handle, said cable casing connector being tubular and including means to receive a flexible casing in fixed axial relationship and extending through front and rear ends of the connector, and a guide slot in an external surface of the cable casing connector, opening through the front end thereof, extending axially along the connector from the opening for less than the entire length of the connector then extending peripherally and then extending axially toward the front end and terminating short of the front end, said guide slot being adapted to receive a radially extending projection within the handle.

78. A thumb piece for a knife having a power-driven annular rotary cutting blade carried by a housing that extends from a support that includes an elongated handle, said thumb piece including means for securing said thumb piece at one end thereof to the support, said securing means including a ring constructed to encircle a portion of said support and wherein said ring includes means to prevent rotation relative to said portion of said support when the ring encircles said portion of the support and is constructed to permit said relative rotation when the ring does not encircle said portion.

79. A handle adapter, for selective attachment on and removal from a rotary knife having a headpiece and a power-driven annular blade supported in a ring housing attached to the headpiece, for securing a handle to the headpiece out of the plane of the blade, said adapter including a support ring that removably and adjustably encircles a part of the headpiece, and a member carried by the support ring for removably and adjustably receiving and supporting a handle offset from a central axis of the ring.

80. A handle adapter as set forth in claim 79, including a key on the ring co-operable with a groove on the headpiece for preventing rotation of the ring about said central axis relative to the headpiece.

81. In combination, a headpiece, an elongated handle and a handle adapter for a knife having a power-driven annular rotary blade, said headpiece comprising a body having a front end for supporting a blade housing, a rear end for attachment to an elongated handle or drive cable support, an elongated throughbore opening through said front and rear ends, said handle constructed for attachment to the handle adapter to orient the handle transversely of said throughbore, said body having a cylindrical boss at the rear end and recesses spaced peripherally about a portion of the boss, and said handle adapter having a ring for surrounding said cylindrical boss and a fastener for adjustably securing the handle to the handle adapter.

82. The combination as set forth in claim 81 wherein the ring is longitudinally moveable on the boss and said recesses are external grooves on the boss, and said ring includes a key receivable in a selected one of said grooves, to prevent relative rotation between the ring and boss.

* * * * *